US010193255B2

(12) United States Patent
Ito et al.

(10) Patent No.: US 10,193,255 B2
(45) Date of Patent: Jan. 29, 2019

(54) PLUG CONNECTOR AND CONNECTOR SET

(71) Applicant: PANASONIC INTELLECTUAL PROPERTY MANAGEMENT CO., LTD., Osaka (JP)

(72) Inventors: Chikara Ito, Mie (JP); Kenji Okura, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 104 days.

(21) Appl. No.: 15/523,796

(22) PCT Filed: Nov. 16, 2015

(86) PCT No.: PCT/JP2015/005690
§ 371 (c)(1),
(2) Date: May 2, 2017

(87) PCT Pub. No.: WO2016/088308
PCT Pub. Date: Jun. 9, 2016

(65) Prior Publication Data

US 2017/0324179 A1 Nov. 9, 2017

(30) Foreign Application Priority Data

Dec. 5, 2014 (JP) ..... 2014-247362
Sep. 18, 2015 (JP) ..... 2015-184939

(51) Int. Cl.
*H01R 12/79* (2011.01)
*H01R 12/68* (2011.01)
(Continued)

(52) U.S. Cl.
CPC ..... *H01R 12/78* (2013.01); *H01R 12/7005* (2013.01); *H01R 12/87* (2013.01); *H01R 13/4538* (2013.01)

(58) Field of Classification Search
CPC ..... H01R 12/79; H01R 12/592; H01R 12/68; H01R 13/506
(Continued)

(56) References Cited

U.S. PATENT DOCUMENTS 5,194,017 A * 3/1993 Consoli ..... H01R 12/57 439/492
5,967,833 A 10/1999 Cachina
(Continued)

FOREIGN PATENT DOCUMENTS

JP 58-97278 6/1983
JP 6-068940 A 3/1994
(Continued)

OTHER PUBLICATIONS

International Search Report, along with English-language translation thereof, issued in PCT/JP2015/005690 dated Jan. 19, 2016.

*Primary Examiner* — Gary Paumen
(74) *Attorney, Agent, or Firm* — Greenblum & Bernstein, P.L.C.

(57) ABSTRACT

A plug connector of the present disclosure includes a plug housing and a plurality of plug terminals stored in the plug housing. This plug connector is fitted in a receptacle connector having a receptacle terminal, and is connected to a cable having a sheet shape and including a cable terminal, thereby establishing electrical connection between the receptacle terminal and the cable terminal. Each of the plug terminals has a contact section and a connection section. The contact section is contactable with the receptacle terminal, and the connection section is connectable to the cable terminal. In a state in which the plug connector is fitted in the receptacle connector, the connection section is disposed such that the connection section is exposed from the plug housing.

15 Claims, 18 Drawing Sheets

(51) Int. Cl.

| | |
|---|---|
| ***H01R 13/506*** | (2006.01) |
| ***H01R 12/78*** | (2011.01) |
| ***H01R 12/87*** | (2011.01) |
| ***H01R 12/70*** | (2011.01) |
| ***H01R 13/453*** | (2006.01) |

(58) Field of Classification Search
USPC ..... 439/492, 498, 499
See application file for complete search history.

(56) References Cited

U.S. PATENT DOCUMENTS 6,364,702 B1 * 4/2002 Mochizuki ..... H01R 13/112 439/499
6,832,931 B1 * 12/2004 Wu ..... H01R 12/592 439/499
8,057,253 B2 * 11/2011 Huang ..... H01R 4/023 439/499
8,083,541 B2 * 12/2011 Yeh ..... H01R 4/023 439/492
8,662,927 B2 * 3/2014 Yu ..... H01R 4/023 439/498
8,753,143 B2 * 6/2014 Su ..... H01R 4/024 439/492
2001/0018291 A1 * 8/2001 Aoki ..... H01R 12/592 439/499
2003/0181094 A1 * 9/2003 Wang ..... H01R 12/592 439/492
2007/0026724 A1 * 2/2007 Mori ..... H01R 13/03 439/492
2009/0011636 A1 * 1/2009 Chung ..... H01R 12/7094 439/499
2013/0052861 A1 * 2/2013 Niitsu ..... H01R 12/65 439/492
2014/0342598 A1 11/2014 Sagayama et al.

FOREIGN PATENT DOCUMENTS

| | | |
|---|---|---|
| JP | 2003-17162 | 1/2003 |
| JP | 2006-236731 | 9/2006 |
| JP | 2013-20800 | 1/2013 |
| JP | 2014-038768 | 2/2014 |
| JP | 2014-225336 A | 12/2014 |

* cited by examiner

PLUG CONNECTOR AND CONNECTOR SET

This application is a U.S. national stage application of the PCT International Application No. PCT/JP2015/005690 filed on Nov. 16, 2015, which claims the benefit of foreign priority of Japanese patent application 2014-247362 filed on Dec. 5, 2014 and Japanese patent application 2015-184939 filed on Sep. 18, 2015, the contents of which are incorporated herein by reference in their entireties.

TECHNICAL FIELD

The present disclosure relates to a plug connector and a connector set that connect circuits.

BACKGROUND ART

As a connector for connecting a sheet-shaped cable such as a flexible printed circuit (hereinafter referred to as FPC) and other circuit to each other, a connector has been known which is produced by storing, inside of a housing, a terminal member that is connected to an exposed portion of a conductor of an FPC (see Patent Literature 1). In such a connector, the terminal member is connected to the FPC by soldering or press fitting, and then, stored in the housing.

Note that a flexible printed circuit has been known as one of sheet-shaped cables.

CITATION LIST

Patent Literature

PTL 1: Unexamined Japanese Patent Publication No. S58-97278

SUMMARY OF THE INVENTION

A plug connector according to one aspect of the present disclosure includes a plug housing and a plurality of plug terminals stored in the plug housing. This plug connector is fitted in a receptacle connector having a receptacle terminal, and is connected to a cable having a sheet shape and including a cable terminal, thereby establishing electrical connection between the receptacle terminal and the cable terminal. Each of the plug terminals has a contact section and a connection section. The contact section is contactable with the receptacle terminal, and the connection section is connectable to the cable terminal. In a state in which the plug connector is fitted in the receptacle connector, the connection section is disposed such that the connection section is exposed from the plug housing.

In addition, a plug set according to one aspect of the present disclosure includes the above-mentioned plug connector and the receptacle connector.

DESCRIPTION OF EMBODIMENTS

Prior to the description of an input operation device according to the present exemplary embodiment, the problem of the technology disclosed in Patent Literature 1 will be described.

In the technology disclosed in Patent Literature 1, it is necessary that a work for connecting the terminal members to the FPC and storing the terminal members in the housing is performed to the terminal members one by one, which makes the work in the connection process complicated.

In view of the foregoing problem, the present disclosure aims to provide a plug connector and a connector set that facilitate the connection with a sheet-like cable.

Next, first to fourth exemplary embodiments of the present disclosure will be described with reference to the drawings. Throughout the description for the drawings, the same or equivalent parts will be indicated with the same reference symbols, and the redundant description will not be repeated. In addition, the first to fourth exemplary embodiments described below merely show a device and method for embodying the technical concept of the present disclosure, and the technical concept of the present disclosure does not specify materials, shapes, structures, arrangements, and the like of components to those described below.

First Exemplary Embodiment

Figure 1:
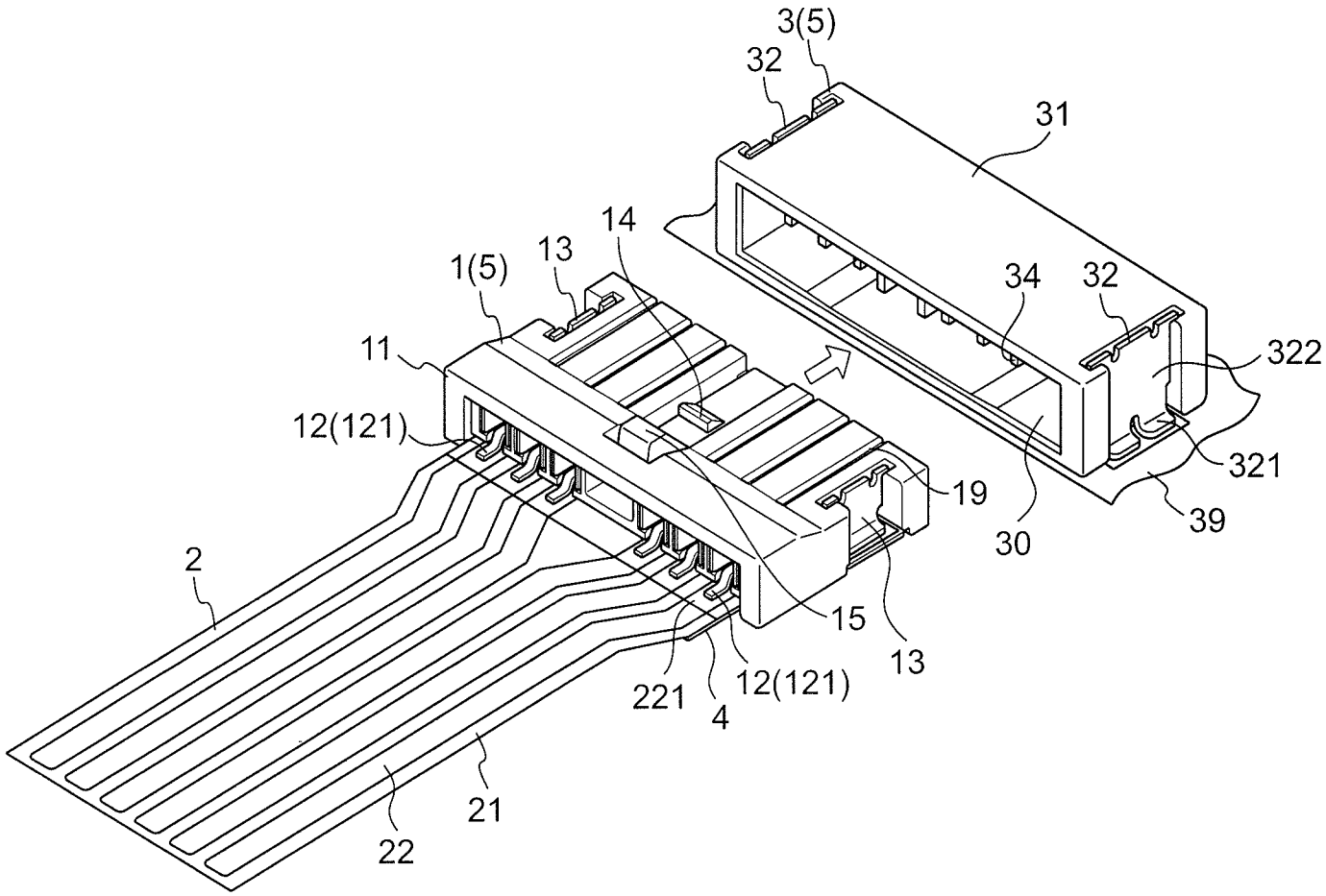
FIG. 1 is a perspective view for describing a basic configuration of a connector set according to a first exemplary embodiment of the present disclosure.
Figure 2:
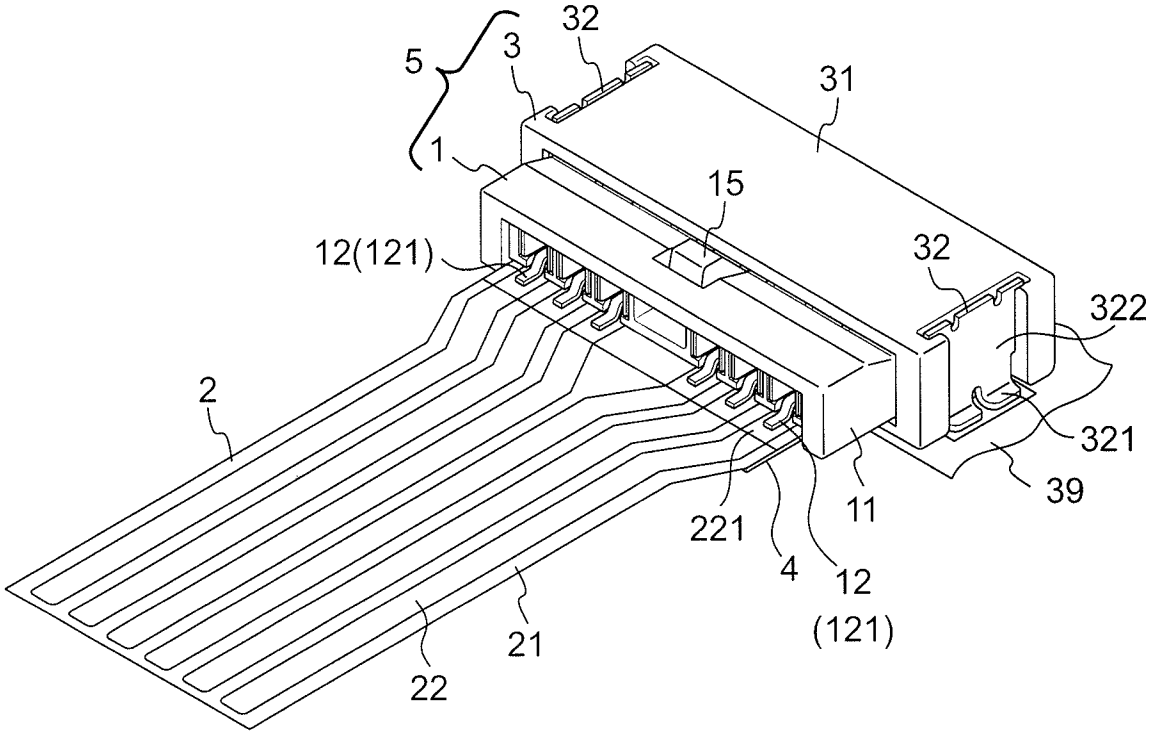
FIG. 2 is a perspective view for describing the basic configuration of the connector set according to the first exemplary embodiment of the present disclosure.

As illustrated in FIGS. 1 and 2, connector set 5 according to the first exemplary embodiment of the present disclosure includes plug connector 1, and receptacle connector 3 fitted in plug connector 1. Plug connector 1 is formed to be connectable to flexible printed circuit 2 (hereinafter referred to as FPC 2). Plug connector 1 is fitted in receptacle connector 3 and connected to FPC 2, thereby establishing electrical connection between receptacle terminals 33 (see FIG. 7, for example) of receptacle connector 3 and flexible printed circuit terminals 221 (hereinafter referred to as FPC terminals 221) of FPC 2. Note that FPC terminals 221 may be referred to as cable terminals.

Plug connector 1 has plug housing 11 having substantially a rectangular solid shape, and a plurality of plug terminals 12 stored in plug housing 11. Plug terminals 12 are arrayed in line in the lateral direction (horizontal direction) in plug housing 11.

Plug housing 11 is injection molded from a resin material, for example. Plug housing 11 has, on the top surface thereof, hook 14 that locks plug connector 1 in the state of being fitted in receptacle connector 3, release button 15 that releases the lock by hook 14, and a plurality of guide grooves 19. Release button 15 is connected to hook 14, and when being pressed, it displaces in conjunction with hook 14. Guide grooves 19 are formed along an insertion/removal direction of plug connector 1 into/from receptacle connector 3.

FPC 2 is a sheet-like cable having support body 21 and conductor layer 22 supported by support body 21. Support body 21 is formed of a plurality of insulator films, and covers conductor layer 22. Conductor layer 22 is a conductive film printed on the insulator films, and forms a plurality of wiring patterns each corresponding to each of plug terminals 12.

Receptacle connector 3 has receptacle housing 31, fixing members 32, and receptacle terminals 33. Receptacle housing 31 has insertion opening 30 into which plug connector 1 is inserted, and guide ribs 34 formed so as to correspond to guide grooves 19. Receptacle housing 31 is injection molded from a resin material, for example. Fixing members 32 are metal fittings for fixing receptacle housing 31 to mounting substrate 39 when receptacle connector 3 is mounted on mounting substrate 39. Each of fixing members 32 is substantially a flat plate extending in the vertical direction, and formed of a metal material. Each of fixing members 32 has connection section 321 formed by bending fixing member 32 on the bottom part thereof, and fixing section 322 which is the remainder except for connection section 321. Fixing section 322 of fixing member 32 is held by receptacle housing 31 and connection section 321 is soldered on mounting substrate 39, whereby receptacle connector 3 is mounted on mounting substrate 39.

Figure 3:
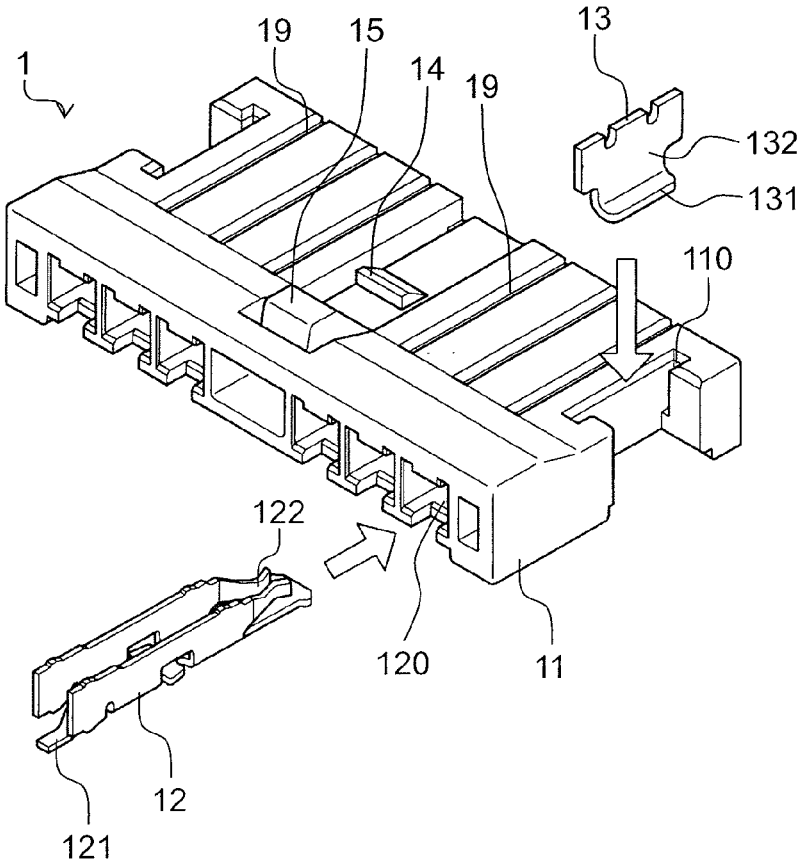
FIG. 3 is an exploded perspective view for describing a plug connector in the connector set according to the first exemplary embodiment of the present disclosure.

As illustrated in FIG. 3, plug housing 11 has a plurality of storing sections 120 extending from one end face to the other end face in the insertion/removal direction of plug connector 1 into/from receptacle connector 3. Plug terminals 12 are inserted into plug housing 11 from openings of storing sections 120 on the side opposite to receptacle connector 3, and stored in plug housing 11. The openings of storing sections 120 on receptacle connector 3 side are formed to be narrower than the openings on the opposite side so as to prevent plug terminals 12 from falling out. Although not illustrated in FIG. 3, the openings of storing sections 120 on receptacle connector 3 side serve as inlet opening 100 (see FIG. 7) into which receptacle terminals 33 enter, and the peripheral edge of inlet opening 100 is formed into a tapered shape so as to facilitate the entry of receptacle terminals 33.

Each of plug terminals 12 is formed such that, for example, a metal plate is stamped into a predetermined shape, and then, the resultant is bent. Each of plug terminals 12 has connection section 121 connected to FPC 2 and contact section 122 which is in contact with receptacle terminal 33 in the state in which plug connector 1 is fitted in receptacle connector 3. Connection sections 121 are disposed such that connection sections 121 are exposed from plug housing 11 so that they are connectable to a plurality of FPC terminals (cable terminals) 221 of single FPC 2. That is, connection sections 121 are located on the same plane formed by FPC 2. Each of contact sections 122 is partially bent so as to hold or press receptacle terminal 33 in the state in which plug connector 1 is fitted in receptacle connector 3.

Specifically, plug connector 1 according to the present exemplary embodiment can be fitted in receptacle connector 3. Plug connector 1 includes plug housing 11 and a plurality of plug terminals 12 stored in plug housing 11. Plug connector 1 according to the present exemplary embodiment is fitted in receptacle connector 3 having receptacle terminals 33. Plug connector 1 according to the present exemplary embodiment is connected to a sheet-like cable (FPC 2) having cable terminals 221, thereby establishing electrical connection between receptacle terminals 33 and cable terminals (FPC terminals 221). Each of plug terminals 12 has contact section 122 and connection section 121. In addition, contact sections 122 can be in contact with receptacle terminals 33, and connection sections 121 can be connected to cable terminals (FPC terminals 221). In a state in which plug connector 1 is fitted in receptacle connector 3, connection sections 121 are disposed such that connection sections 121 are exposed from plug housing 11.

Plug housing 11 has holders 110 for holding fixing members 13 that fix plug housing 11 and FPC 2 to each other when plug housing 11 is connected to FPC 2. Each of holders 110 is formed to correspond to the shape of fixing member 13 on each of both side surfaces of plug connector 1 in the arraying direction of plug terminals 12. Each of fixing members 13 is substantially a flat plate extending in the vertical direction, and formed of a metal material. Each of fixing members 13 has connection section 131 formed by bending fixing member 13 on the bottom part thereof, and fixing section 132 which is the remainder except for connection section 131, fixing section 132 having a horizontal width larger than that of connection section 131. Fixing members 13 are inserted into holders 110 from the top surface of plug housing 11, and holders 110 hold fixing members 13 in a state in which connection sections 131 are exposed from the lower surface of plug housing 11.

Figure 4:
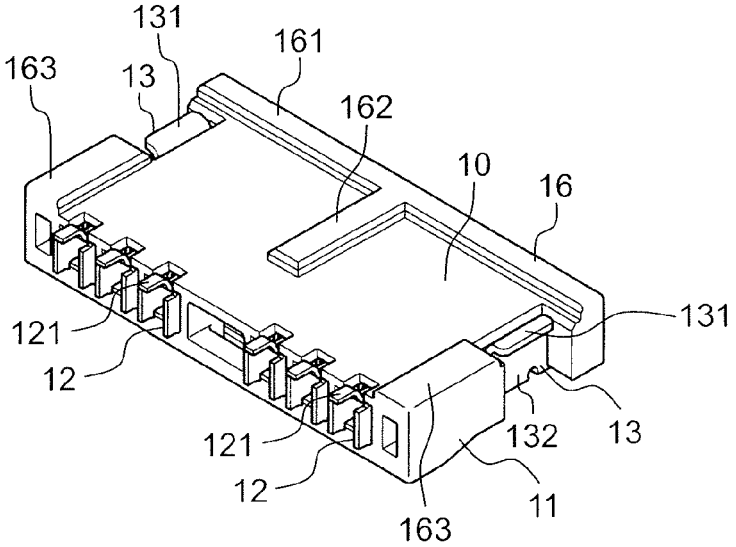
FIG. 4 is a perspective view for describing a back surface side of the plug connector in the connector set according to the first exemplary embodiment of the present disclosure.

As illustrated in FIG. 4, plug housing 11 has, on the lower surface thereof, recessed section 10 which is formed to be recessed corresponding to the shape of FPC 2, and projecting section 16 which is the remainder except for recessed section 10. Recessed section 10 is formed into a horizontal plane with a size, smaller than that of projecting section 16, in the vertical direction of plug housing 11. Recessed section 10 is formed such that the positions of the lower ends of connection sections 121 of plug terminals 12 and the positions of the lower ends of connection sections 131 of fixing members 13 are vertically the same.

Projecting section 16 on the lower surface of plug housing 11 has: projecting section 161 which is formed to serve as one side on receptacle connector 3 side; projecting section 162 extending from the center of projecting section 161 in the direction orthogonal to projecting section 161; and projecting sections 163 separated from projecting sections 161 and 162. Projecting section 162 extends to the center of recessed section 10 from projecting section 161. Projecting sections 163 are formed on both sides of plug housing 11 in the extending direction of projecting section 161. Connection section 131 of each of fixing members 13 is located between projecting section 161 and each of projecting sections 163.

Figure 5:
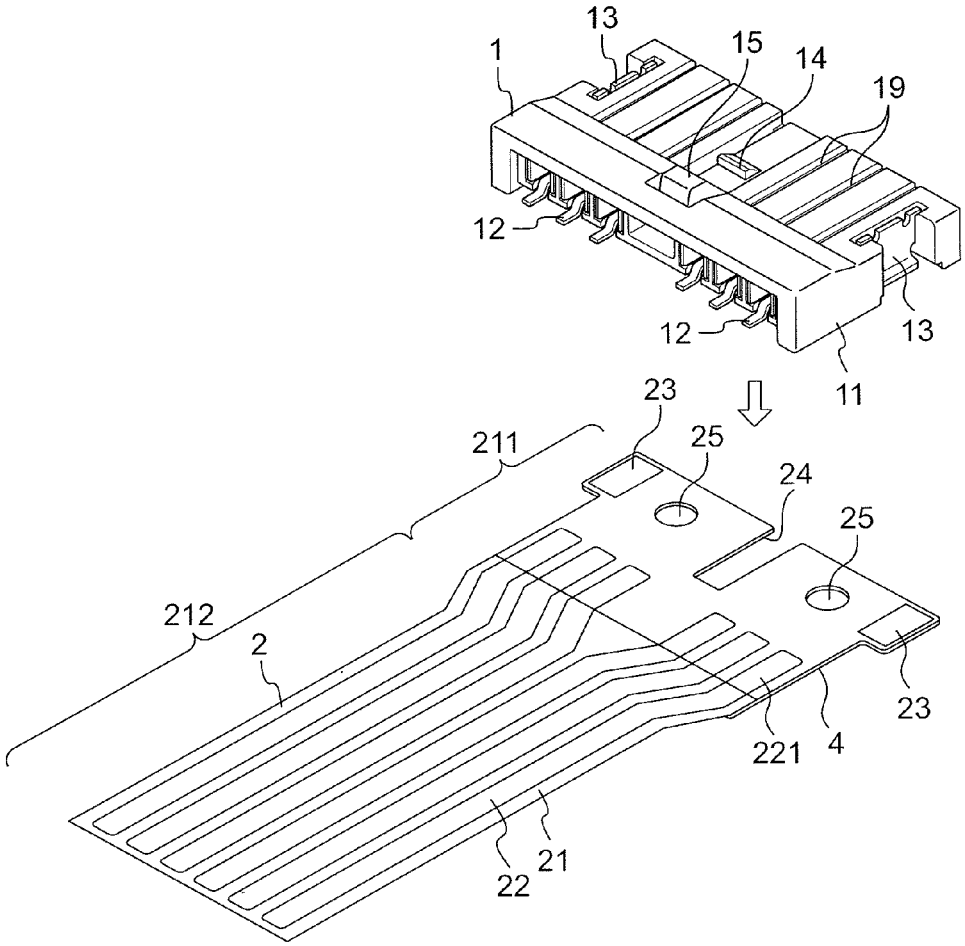
FIG. 5 is a perspective view for describing a state in which the plug connector and an FPC in the connector set according to the first exemplary embodiment of the present disclosure are connected to each other.

As illustrated in FIG. 5, FPC 2 has: coupling region 211 used for the coupling with plug connector 1; and extension region 212 on which conductor layer 22 for wiring with other circuit extends. Coupling region 211 is located on one end of extension region 212. Extension region 212 is located on the side opposite to receptacle connector 3, in a state in which coupling region 211 is coupled to plug connector 1.

FPC 2 has, on the upper surface thereof in coupling region 211, a plurality of FPC terminals 221 which is conductor layer 22 exposed from support body 21, and connection terminals 23 connected to fixing members 13. Coupling region 211 is formed to correspond to the shape of recessed section 10 of plug housing 11. Alternatively, recessed section 10 is formed to correspond to the shape of coupling region 211 of FPC 2 on which FPC terminals 221 are formed. Connection terminals 23 are formed in the same manner as conductor layer 22 in the printing process of conductor layer 22, for example.

In the present exemplary embodiment, plug housing 11 has recessed section 10. The shape of recessed section 10 corresponds to the shape of coupling region 211 of the cable (FFC 2) on which a plurality of cable terminals (FPC terminals 221) is formed.

In addition, connection terminals 23 are formed on positions corresponding to the positions of fixing members 13, and formed to project in the direction orthogonal to the insertion/removal direction of plug connector 1 on both ends of coupling region 211. Besides, FPC 2 has, on coupling region 211, slit 24 formed to correspond to projecting section 162 and through-holes 25 formed to be located on recessed section 10.

Plug connector 1 is coupled to FPC 2 by connecting plug terminals 12 and cable terminals 221 to each other by soldering in a state in which coupling region 211 of FPC 2 is stored in recessed section 10. Plug connector 1 is strongly fixed to FPC 2 by connecting connection sections 131 of fixing members 13 held by holders 110 to connection terminals 23 by soldering.

Figure 6:
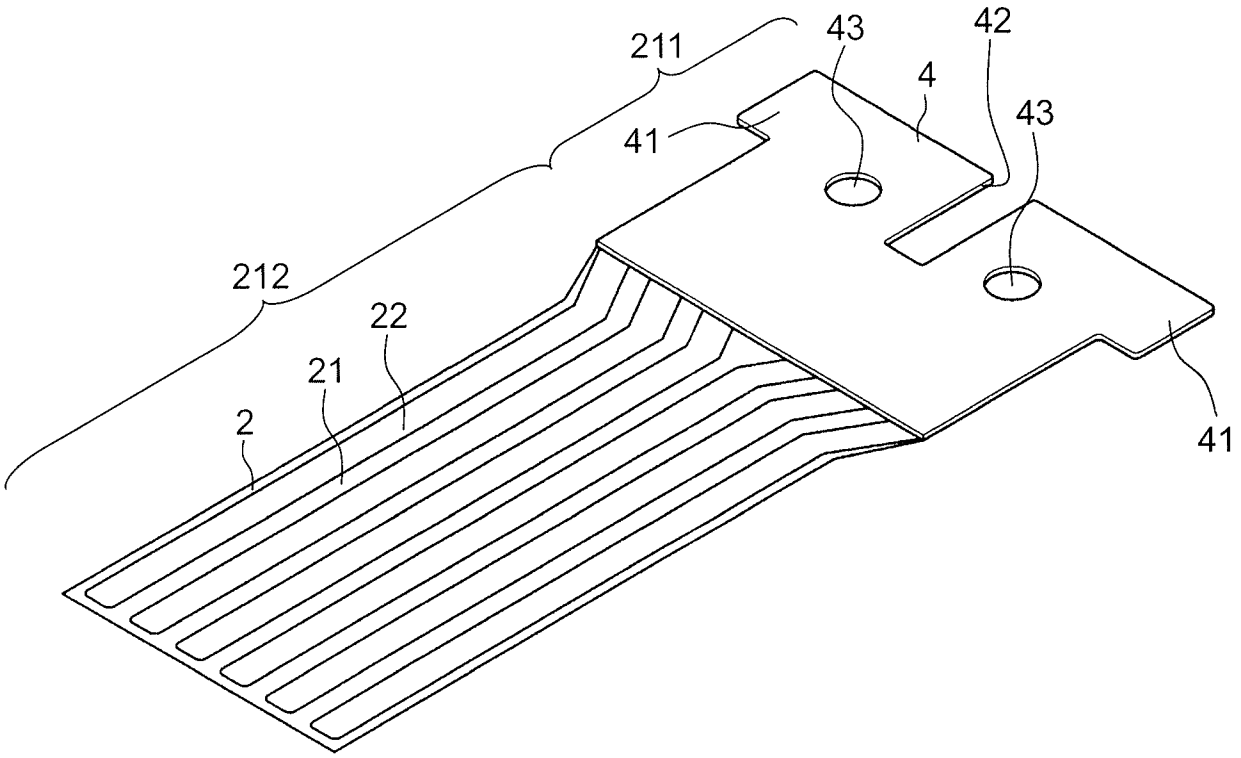
FIG. 6 is a perspective view for describing a back surface side of the FPC in the connector set according to the first exemplary embodiment of the present disclosure.

As illustrated in FIG. 6, plug connector 1 may further have reinforcement plate 4 for reinforcing FPC 2 that has been coupled. Reinforcement plate 4 is formed of glass epoxy resin, stainless steel, or the like, for example, and formed to correspond to the shape of coupling region 211 of FPC 2. Reinforcement plate 4 has the same shape as coupling region 211 in a plan view. Specifically, reinforcement plate 4 has protruding sections 41 corresponding to the positions of connection terminals 23, slit 42 corresponding to slit 24, and through-holes 43 corresponding to through-holes 25. Reinforcement plate 4 holds coupling region 211 of FPC 2 with plug connector 1 in the state in which coupling region 211 is stored in recessed section 10, thereby reinforcing coupling region 211 of FPC 2. Reinforcement plate 4 is positioned with respect to coupling region 211, and attached on the back surface of FPC 2 by means of an adhesive.

The total thickness of FPC 2 and reinforcement plate 4 which are attached to each other is equal to or less than the difference between the lower surface of recessed section 10 and the lower surface of projecting section 16. The lower surface of recessed section 10 is a surface indicated by lead line 10 in FIG. 4, for example, and the lower surface of projecting section 16 is a surface indicated by lead line 16 in FIG. 4, for example.

Figure 7:
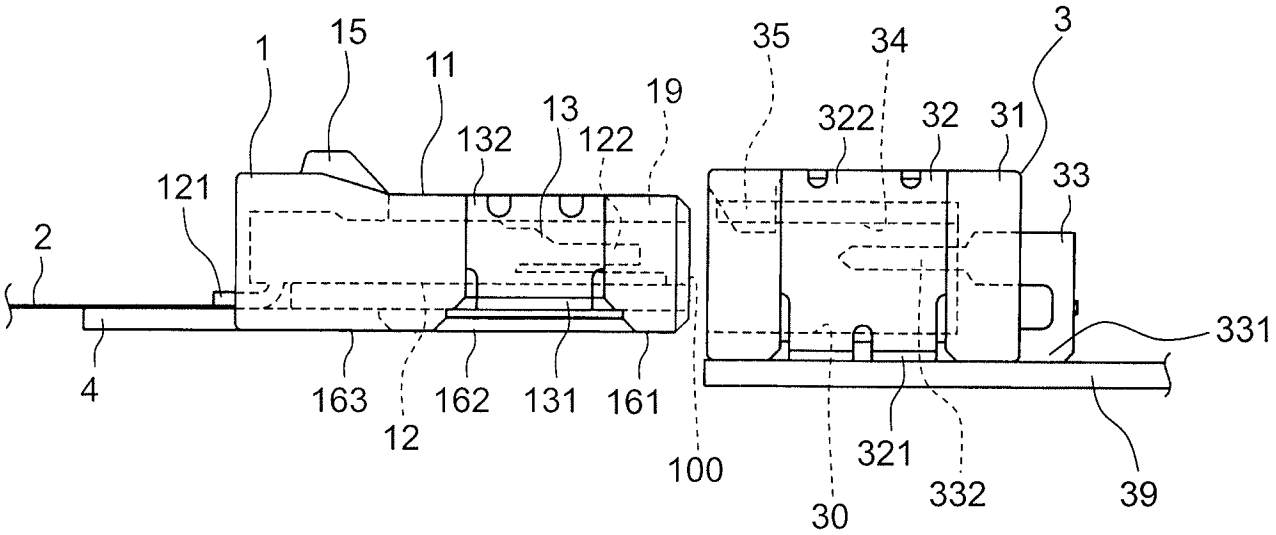
FIG. 7 is a front view for describing the connector set according to the first exemplary embodiment of the present disclosure.

Projecting sections 161 to 163 are horizontally on the same position. In addition, as illustrated in FIG. 7, projecting section 162 and projecting sections 163 are disposed to overlap each other in the insertion/removal direction of plug connector 1. Specifically, recessed section 10 and projecting section 16 can prevent the lower surface of plug connector 1 from being stuck at insertion opening 30 of receptacle connector 3, when plug connector 1 coupled to FPC 2 which is reinforced by reinforcement plate 4 is inserted or removed into or from receptacle connector 3.

In addition, projecting sections 161 to 163 are formed to correspond to a planar pattern of coupling region 211 so that projecting section 162 is formed to correspond to slit 24 (see FIG. 5) and slit 42 (see FIG. 6). Therefore, FPC 2 and reinforcement plate 4 are substantially fixed in a planar direction in the state of being fitted in recessed section 10, thereby being easily positioned with respect to plug connector 1.

Each of receptacle terminals 33 is provided to reach the outside of receptacle housing 31 opposite to insertion opening 30 from the inside of insertion opening 30. Each of receptacle terminals 33 is formed of a metal material, for example, and has substantially an L shape. Receptacle terminal 33 has connection section 331 located on the outside of receptacle housing 31 and contact section 332 located inside of insertion opening 30. When plug connector 1 is inserted into insertion opening 30, contact section 332 is introduced into inlet opening 100 and brought into contact with contact section 122 in the state in which plug connector 1 is fitted in receptacle connector 3. Connection sections 321 and connection sections 331 are connected to terminals on mounting substrate 39 by soldering or the like, whereby receptacle connector 3 is mounted on mounting substrate 39.

Receptacle connector 3 has, on the top surface inside of insertion opening 30, hook receiving section 35 as well as guide ribs 34, hook receiving section being hooked on hook 14 of plug connector 1 to lock plug connector 1 in the state in which plug connector 1 is fitted in receptacle connector 3. When release button 15 is operated in the state in which plug connector 1 is fitted in receptacle connector 3, hook 14 is released from hook receiving section 35. When the lock between plug connector 1 and receptacle connector 3 is released in this way, plug connector 1 can be removed from receptacle connector 3.

Specifically, in plug connector 1 according to the present exemplary embodiment, when receptacle connector 3 is mounted on mounting substrate 39, recessed section 10 is located on the surface, facing mounting substrate 39, of outer surfaces of plug housing 11.

Figure 8:
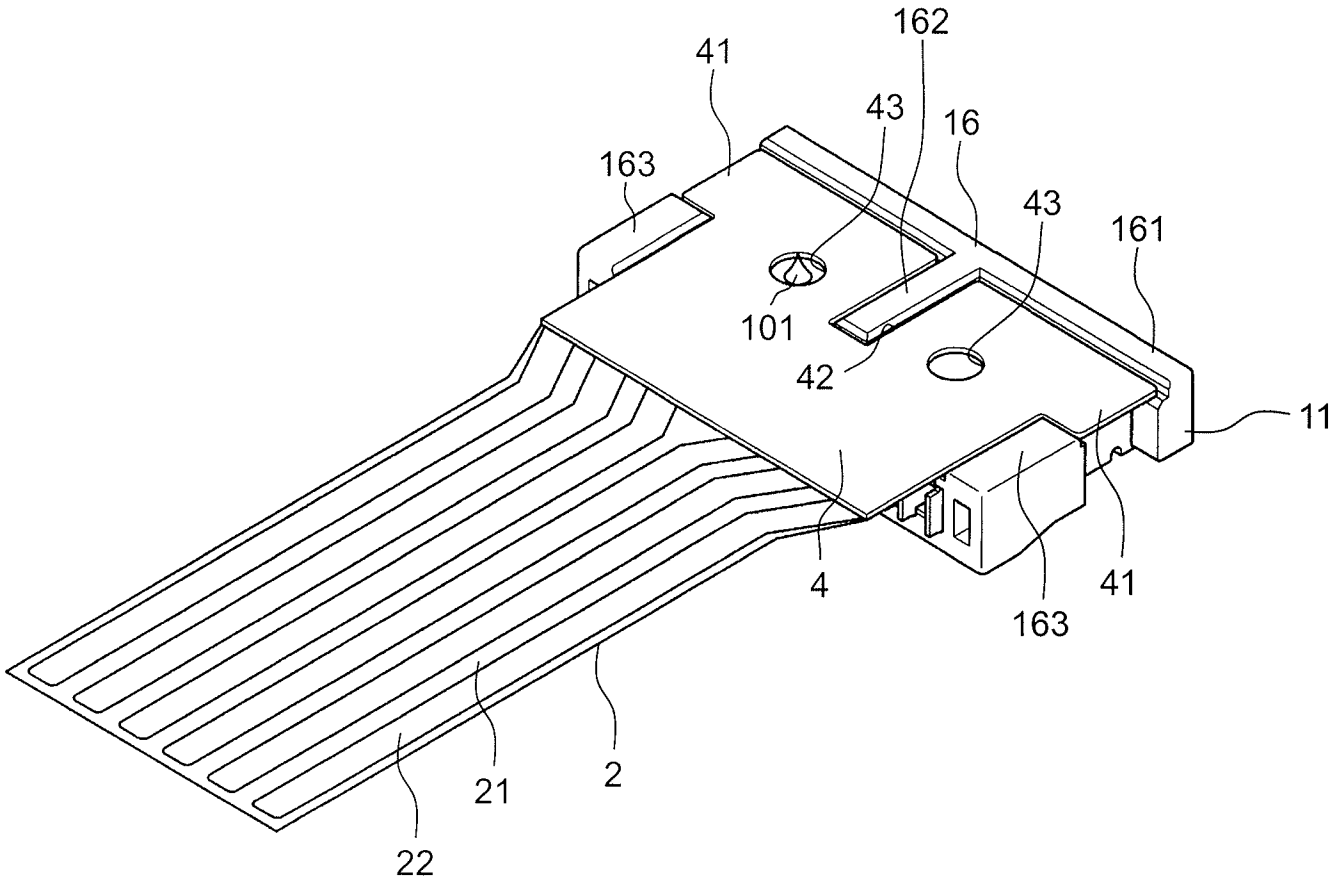
FIG. 8 is a perspective view for describing the back surface side of the plug connector in the connector set according to the first exemplary embodiment of the present disclosure.

Note that plug housing 11 is preferably formed by using a die of which injection opening (gate) in injection molding is located on recessed section 10. In addition, it is preferable that through-holes 25 of FPC 2 and through-holes 43 on reinforcement plate 4 are formed on positions corresponding to the gate. The reason of this is as follows. Even if molding failure 101 such as a protrusion is caused as illustrated in FIG. 8, FPC 2 is not lifted from recessed section 10, and plug connector 1 can be smoothly inserted and removed into and from receptacle connector 3 without being stuck.

According to connector set 5 in the first exemplary embodiment of the present disclosure, connection sections 121 of plug terminals 12 stored in plug housing 11 are disposed in a predetermined pattern such that connection sections 121 are exposed from plug housing 11, whereby connection and coupling with FPC 2 are facilitated. Thus, complicated work in the connection process is removed, and production cost of a product using connector set 5 can be reduced.

Second Exemplary Embodiment

The first exemplary embodiment has described, as one example, plug connector 1 connected to FPC 2 and mounting substrate 39 which extend along the insertion/removal direction of plug connector 1. Plug connector 1 may be connected to FPC 2 in an orientation other than that described above.

Figure 9:
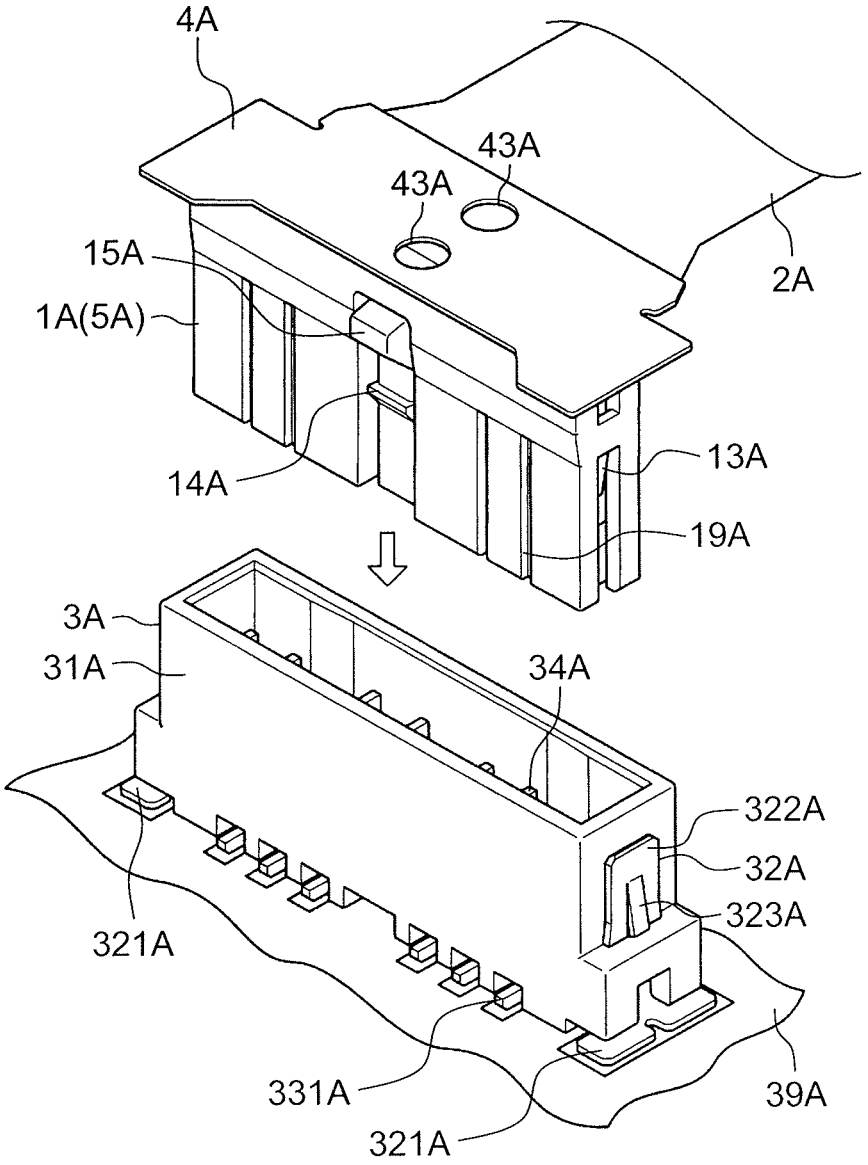
FIG. 9 is a perspective view for describing a basic configuration of a connector set according to a second exemplary embodiment of the present disclosure.
Figure 10:
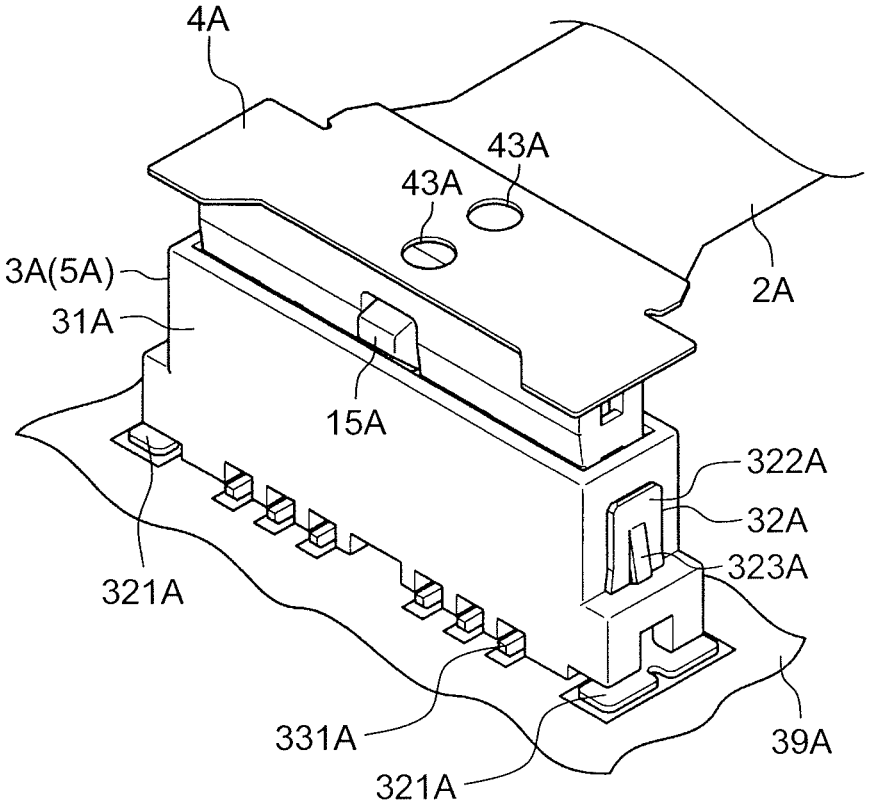
FIG. 10 is a perspective view for describing the basic configuration of the connector set according to the second exemplary embodiment of the present disclosure.

As illustrated in FIGS. 9 and 10, connector set 5A (1A, 3A) according to the second exemplary embodiment of the present disclosure is different from the first exemplary embodiment in that plug connector 1A is connected to flexible printed circuit 2A (hereinafter referred to as FPC 2A) disposed orthogonal to an insertion/removal direction of plug connector 1A into/from receptacle connector 3A. In the second exemplary embodiment, the other configurations which will not be described are substantially similar to the configurations in the first exemplary embodiment, and the redundant description thereof will be omitted.

Figure 11:
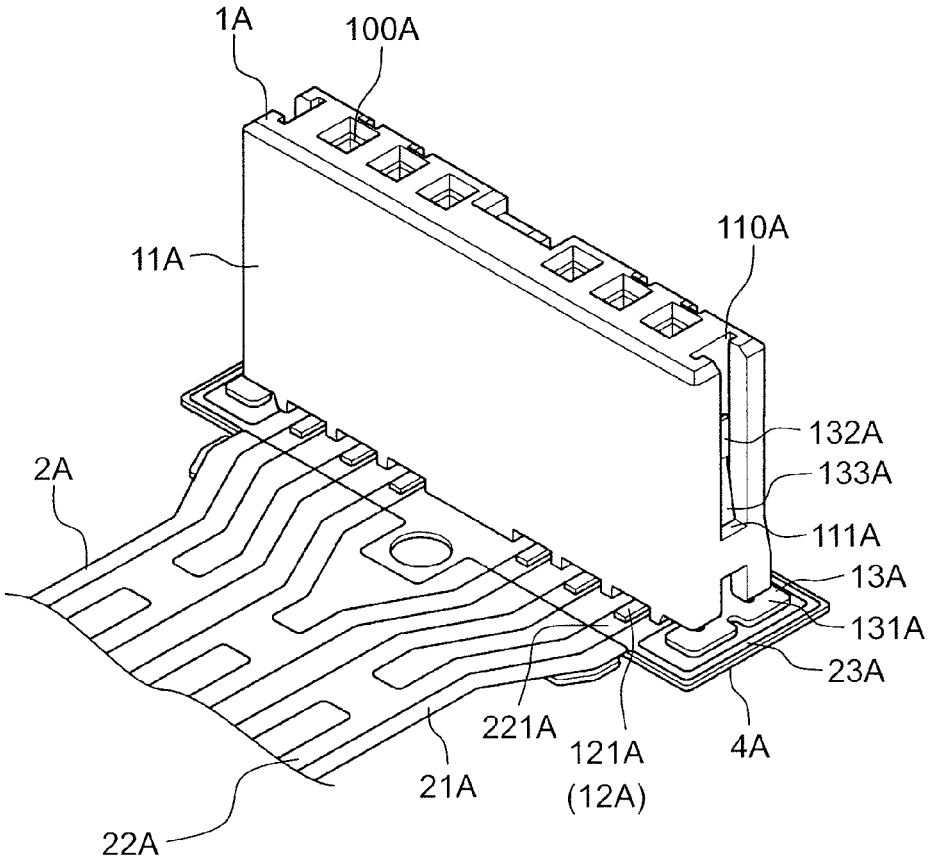
FIG. 11 is a perspective view for describing a plug connector in the connector set according to the second exemplary embodiment of the present disclosure.

As illustrated in FIG. 11, plug connector 1A has plug housing 11A having substantially a rectangular solid shape, and a plurality of plug terminals 12A (see FIG. 12) stored in plug housing 11A. Plug connector 1A is connected to FPC 2A on an end face opposite to inlet opening 100A.

Plug housing 11A has holders 110A for holding fixing members 13A that fix plug housing 11A and FPC 2A to each other when plug housing 11A is connected to FPC 2A. Each of holders 110A is formed to correspond to the shape of fixing member 13A on each of both side surfaces of plug housing 11A in the arraying direction of plug terminals 12.

Figure 12:
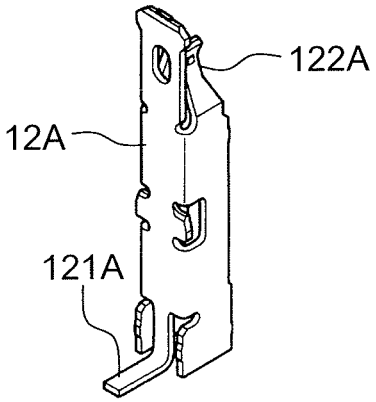
FIG. 12 is a perspective view for describing a plug terminal used in the connector set according to the second exemplary embodiment of the present disclosure.

As illustrated in FIG. 12, each of plug terminals 12A has connection section 121A connected to FPC 2A and contact section 122A which is in contact with receptacle terminal 33A (see FIG. 14) in the state in which plug connector 1A is fitted in receptacle connector 3A. Connection sections 121A are disposed such that connection sections 121A are exposed from plug housing 11A on the end face opposite to inlet opening 100A so that connection sections 121A are connectable to a plurality of FPC terminals 221A of single FPC 2A.

Figure 13:
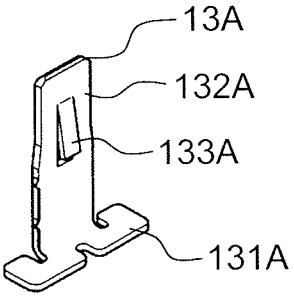
FIG. 13 is a perspective view for describing a fixing member used in the connector set according to the second exemplary embodiment of the present disclosure.

As illustrated in FIG. 13, each of fixing members 13A is substantially a flat plate extending in the vertical direction. Each of fixing members 13A has connection section 131A formed by bending fixing member 13A on the bottom part thereof, fixing section 132A which is the remainder except for connection section 131A and can be inserted into holder 110A, and hook 133A formed on the center of fixing section 132A. Fixing members 13A are inserted into holders 110A from the end face opposite to inlet opening 100A, and held as being fixed to plug housing 11A by hooks 133A being hooked on hook receiving sections 111A of holders 110A. Holders 110A hold fixing members 13A in the state in which connection sections 131A are exposed from the side opposite to inlet opening 100A of plug housing 11A.

Connection sections 121A are connected to FPC terminals 221A of FPC 2A by soldering or the like, and connection sections 131A are connected to connection terminals 23A of FPC 2A by soldering or the like, whereby plug connector 1A is vertically mounted on FPC 2A and reinforcement plate 4A.

Specifically, in the present exemplary embodiment, cable terminals (FPC terminals 221A) and connection sections 121A are connected to each other by soldering, whereby plug connector 1A is connected to cable (PFC 2A).

In addition, plug connector 1 is connected to the cable (PFC 2A) by connecting connection terminals 23A and connection sections 131A to each other by soldering.

Note that, in other exemplary embodiments, they may be connected to each other by soldering as in the present exemplary embodiment.

Figure 14:
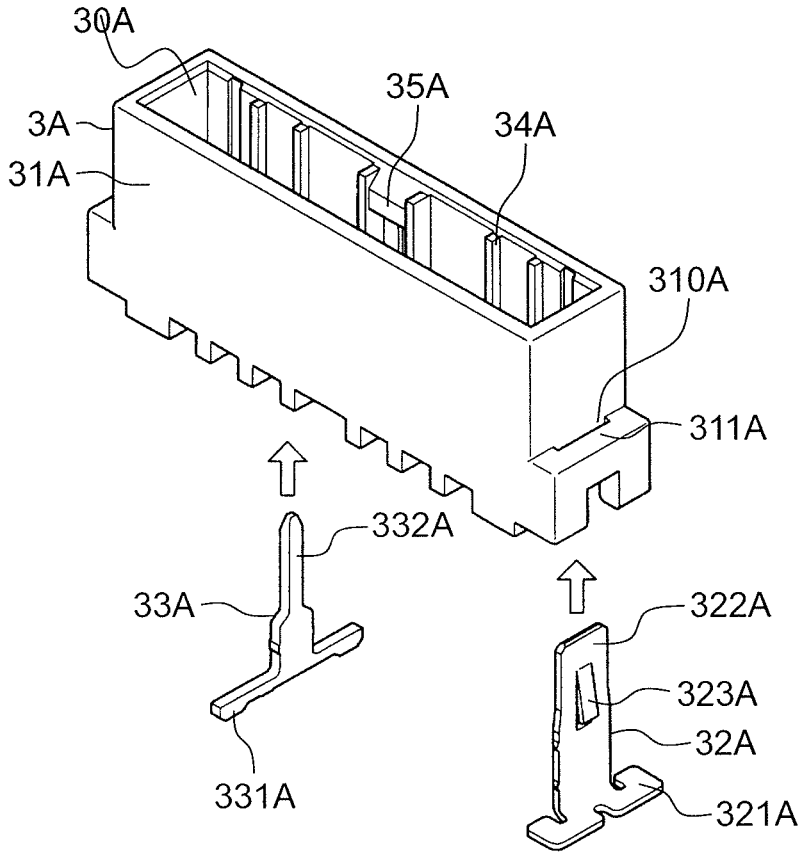
FIG. 14 is an exploded perspective view for describing a receptacle connector in the connector set according to the second exemplary embodiment of the present disclosure.

As illustrated in FIG. 14, receptacle connector 3A has receptacle housing 31A, fixing members 32A, and receptacle terminals 33A. Receptacle housing 31A has insertion opening 30A into which plug connector 1A is inserted, guide ribs 34A formed so as to correspond to guide grooves 19, and holders 310A for holding fixing members 32A. Each of holders 310A is formed to correspond to the shape of fixing member 32A on each of both side surfaces of receptacle housing 31A in the arraying direction of receptacle terminals 33A.

Each of fixing members 32A is substantially a flat plate extending in the vertical direction. Each of fixing members 32A has connection section 321A formed by bending fixing member 32A on the bottom part thereof, fixing section 322A which is the remainder except for connection section 321A and can be inserted into holder 310A, and hook 323A formed on the center of fixing section 322A. Fixing members 32A are inserted into holders 310A from the end face opposite to insertion opening 30A, and held as being fixed to receptacle housing 31A by hooks 323A being hooked on hook receiving sections 311A of holders 310A. Holders 310A hold fixing members 32A in the state in which connection sections 321A are exposed from the side opposite to insertion opening 30A of receptacle housing 31A.

Each of receptacle terminals 33A is formed of a metal material, for example, and has substantially a T shape. Each of receptacle terminals 33A has connection section 331A located on the outside of receptacle housing 31A and contact section 332A located inside of insertion opening 30A. Receptacle terminals 33A are inserted from the side opposite to insertion opening 30A of receptacle housing 31A. When plug connector 1A is inserted into insertion opening 30A, contact sections 332A are introduced into inlet opening 100A (see FIG. 11) and brought into contact with contact sections 122A in the state in which plug connector 1A is fitted in receptacle connector 3A.

Connection sections 321A and connection sections 331A are connected to terminals on mounting substrate 39A by soldering or the like, whereby receptacle connector 3 is vertically mounted on mounting substrate 39A.

According to connector set 5A (1A, 3A) in the second exemplary embodiment of the present disclosure, connection sections 121A of plug terminals 12A are disposed in a predetermined pattern such that connection sections 121A are exposed from plug housing 11A, whereby connection and coupling with FPC 2A are facilitated. Thus, complicated work in the connection process is removed, and production cost of a product using connector set 5A (1A, 3A) can be reduced.

Third Exemplary Embodiment

Figure 15:
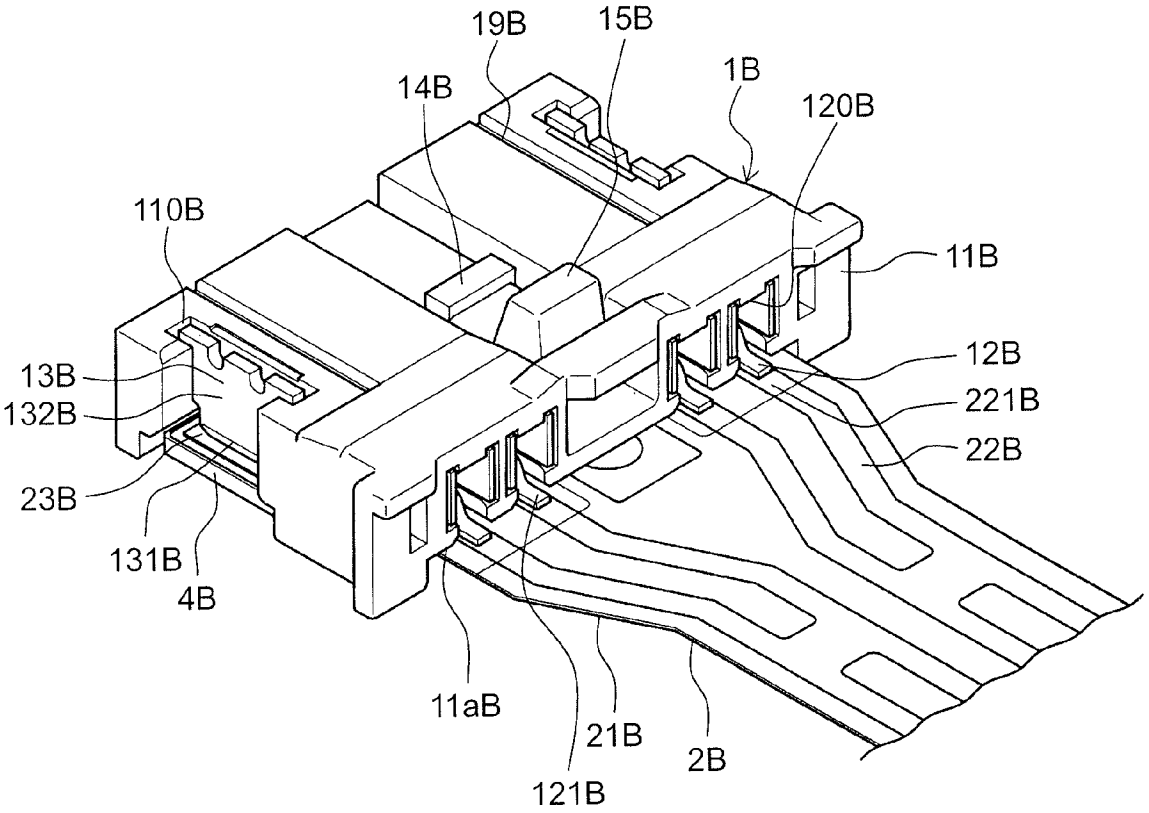
FIG. 15 is a perspective view for describing a plug connector in a connector set according to a third exemplary embodiment of the present disclosure.
Figure 16:
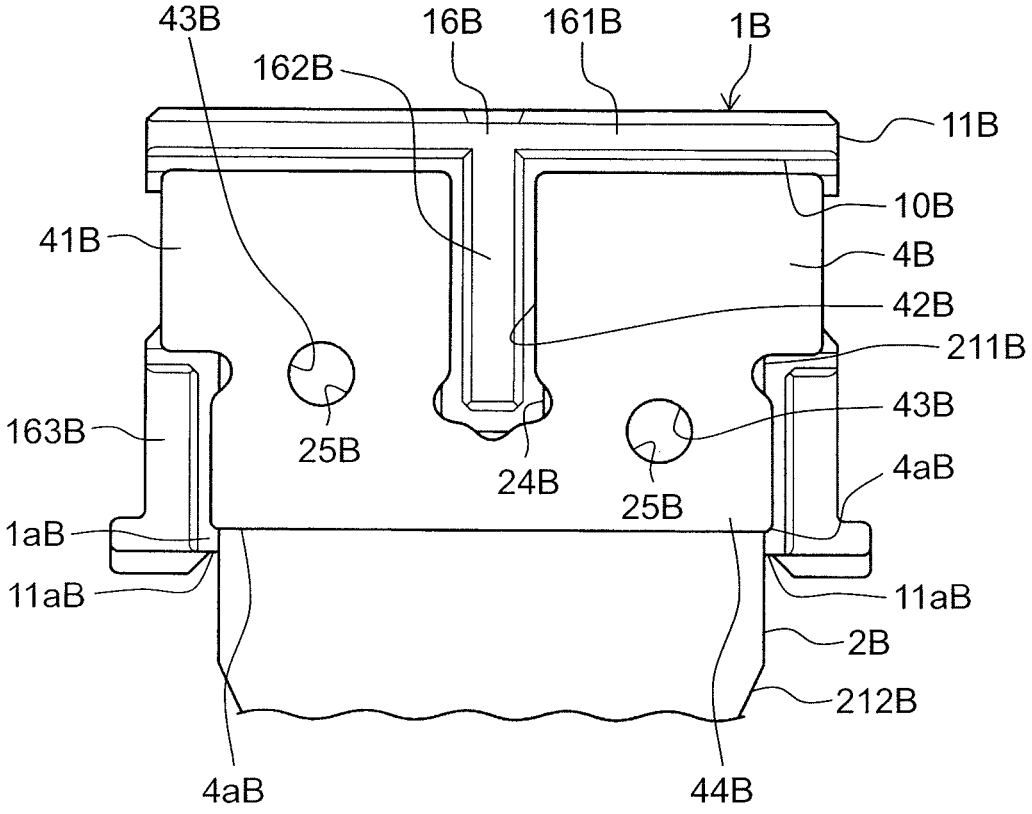
FIG. 16 is a back view for describing the plug connector in the connector set according to the third exemplary embodiment of the present disclosure.

A plug connector in a connector set can be configured as plug connector 1B illustrated in FIGS. 15 and 16.

Plug connector 1B according to the third exemplary embodiment of the present disclosure is connected to flexible printed circuit 2B (hereinafter referred to as FPC 2B) which extends in the direction along an insertion/removal direction of plug connector 1B and mounting substrate which is not illustrated, as in plug connector 1 described in the first exemplary embodiment. In addition, plug connector 1B is fitted in a receptacle connector, which is not illustrated, to constitute a portion of connector set 5. Note that the receptacle connector in which plug connector 1B according to the third exemplary embodiment of the present disclosure is fitted can be configured to have a shape almost similar to the shape of receptacle connector 3 in the first exemplary embodiment.

Plug connector 1B has plug housing 11B having substantially a rectangular solid shape, and a plurality of plug terminals 12B stored in plug housing 11B. Plug terminals 12B are arrayed in line in the lateral direction (horizontal direction) in plug housing 11B.

Plug housing 11B is injection molded from a resin material, for example, and is harder than FPC (cable) 2B. Plug housing 11B has, on the top surface thereof, hook 14B that locks plug connector 1B in the state of being fitted in the receptacle connector, release button 15B that releases the lock by hook 14B, and a plurality of guide grooves 19B. Release button 15B is connected to hook 14B, and when being pressed, it displaces in conjunction with hook 14B. Guide grooves 19B are formed along the insertion/removal direction of plug connector 1B into/from the receptacle connector.

FPC 2B is a sheet-like cable having support body 21B and conductor layer 22B supported by support body 21B. Support body 21B is formed of a plurality of insulator films, and covers conductor layer 22B. Conductor layer 22B is a conductive film printed on the insulator films, and forms a plurality of wiring patterns each corresponding to each of plug terminals 12B.

As illustrated in FIG. 15, plug housing 11B has a plurality of storing sections 120B extending from one end face to the other end face in the insertion/removal direction of plug connector 1B into/from the receptacle connector. Plug terminals 12B are inserted into plug housing 11B from openings of storing sections 120B on the side opposite to the receptacle connector, and stored in plug housing 11B. The openings of storing sections 120B on the receptacle connector side are formed to be narrower than the openings on the opposite side so as to prevent plug terminals 12B from falling out. Although not illustrated, the openings of storing sections 120B on the receptacle connector side serve as an inlet opening into which receptacle terminals enter, and the peripheral edge of the inlet opening is formed into a tapered shape so as to facilitate the entry of the receptacle terminals.

Plug terminals 12B can be configured to have shapes almost similar to the shapes of plug terminals 12 in the first exemplary embodiment. For example, each of plug terminals 12B is formed such that a metal plate is stamped into a predetermined shape, and then, the resultant is bent. Specifically, each of plug terminals 12B has connection section 121B connected to FPC 2B and a contact section (not illustrated in FIG. 15) which is in contact with the receptacle terminal (not illustrated in FIG. 15) in the state in which plug connector 1B is fitted in the receptacle connector. Connection sections 121B are disposed such that connection sections 121B are exposed from plug housing 11B so that connection sections 121B are connectable to a plurality of FPC terminals (cable terminals) 221B of single FPC 2B. That is, connection sections 121B are located on the same plane formed by FPC 2B. Each of the contact sections is partially bent so as to hold or press the receptacle terminal in the state in which plug connector 1B is fitted in the receptacle connector.

Plug housing 11B has holders 110B for holding fixing members 13B that fix plug housing 11B and FPC 2B to each other when plug housing 11B is connected to FPC 2B. Each of holders 110B is formed to correspond to the shape of fixing member 13B on each of both side surfaces of plug connector 1B in the arraying direction of plug terminals 12B. Each of fixing members 13B is substantially a flat plate extending in the vertical direction, and formed of a metal material. Each of fixing members 13B has connection section 131B formed by bending fixing member 13B on the bottom part thereof, and fixing section 132B which is the remainder except for connection section 131B, fixing section 132B having a horizontal width larger than that of connection section 131B. Fixing members 13B are inserted into holders 110B from the top surface of plug housing 11B, and holders 110B hold fixing members 13B in a state in which connection sections 131B are exposed from the lower surface of plug housing 11B.

As illustrated in FIG. 16, plug housing 11B has, on the lower surface thereof, recessed section 10B which is formed to be recessed corresponding to the shape of FPC 2B, and projecting section 16B which is the remainder except for recessed section 10B. Recessed section 10B is formed into a horizontal plane with a size, smaller than that of projecting section 16B, in the vertical direction of plug housing 11B. Recessed section 10B is formed such that the positions of the lower ends of connection sections 121B of plug terminals 12B and the positions of the lower ends of connection sections 131B of fixing members 13B are vertically the same.

Projecting section 16B on the lower surface of plug housing 11B has: projecting section 161B which is formed to serve as one side on the receptacle connector side; projecting section 162B extending from the center of projecting section 161B in the direction orthogonal to projecting section 161B; and projecting sections 163B separated from projecting sections 161B and 162B. Projecting section 162B extends to the center of recessed section 10B from projecting section 161B. Projecting sections 163B are formed on both sides of plug housing 11B in the extending direction of projecting section 161B. Connection section 131B of fixing member 13B is located between one end of projecting section 161B and projecting section 163B, and connection section 131B of another fixing member 13B is located between the other end of projecting section 161B and projecting section 163B (see FIG. 15).

As illustrated in FIG. 16, FPC 2B has: coupling region 211B used for the coupling with plug connector 1B; and extension region 212B on which conductor layer 22B for wiring with other circuit extends. Coupling region 211B is located on one end of extension region 212B. Extension region 212B is located on the side opposite to the receptacle connector, in a state in which coupling region 211B is coupled to plug connector 1B.

FPC 2B has, on the upper surface thereof in coupling region 211B, a plurality of FPC terminals 221B which is conductor layer 22B exposed from support body 21B, and connection terminals 23B connected to fixing members 13B. Coupling region 211B is formed to correspond to the shape of recessed section 10B of plug housing 11B. Alternatively, recessed section 10B is formed to correspond to the shape of coupling region 211B of FPC 2B on which FPC terminals 221B are formed. Connection terminals 23B are formed in the same manner as conductor layer 22B in the printing process of conductor layer 22B, for example.

As illustrated in FIG. 15, connection terminals 23B are formed on positions corresponding to the positions of fixing members 13B, and formed to project in the direction orthogonal to the insertion/removal direction of plug connector 1B on both ends of coupling region 211B. Besides, FPC 2B has, on coupling region 211B, slit 24B formed to correspond to projecting section 162B and through-holes 25B formed to be located on recessed section 10B.

Plug connector 1B is coupled to FPC 2B by connecting plug terminals 12B and FPC terminals 221B to each other by soldering in a state in which coupling region 211B of FPC 2B is stored in recessed section 10B. In the present exemplary embodiment, cable terminals (FPC terminals 221B) and connection sections 121B are connected to each other by soldering, whereby plug connector 1B is connected to the cable (PFC 2B).

In addition, plug connector 1B is strongly fixed to FPC 2B by connecting connection sections 131B of fixing members 13B held by holders 110B to connection terminals 23B by soldering.

As illustrated in FIGS. 15 and 16, plug connector 1B may further have reinforcement plate 4B for reinforcing FPC 2B that has been coupled. Reinforcement plate 4B is formed of glass epoxy resin, stainless steel, or the like, for example, and is harder than FPC (cable) 2B. In addition, reinforcement plate 4B is formed to correspond to the shape of coupling region 211B of FPC 2B. Reinforcement plate 4B has almost the same shape as coupling region 211B in a plan view. Specifically, reinforcement plate 4B has protruding sections 41B corresponding to the positions of connection terminals 23B, slit 42B corresponding to slit 24B, and through-holes 43B corresponding to through-holes 25B. Reinforcement plate 4B holds coupling region 211B of FPC 2B with plug connector 1B in the state in which coupling region 211B is stored in recessed section 10B, thereby reinforcing coupling region 211B of FPC 2B. Reinforcement plate 4B is positioned with respect to coupling region 211B, and attached on the back surface of FPC 2B by means of an adhesive.

Specifically, in the present exemplary embodiment, coupling region 211B of the cable (FPC 2B) on which a plurality of cable terminals (FPC terminals 221B) is formed is held between reinforcement plate 4B and plug connector 1B.

The total thickness of FPC 2B and reinforcement plate 4B which are attached to each other is equal to or less than the difference between the lower surface of recessed section 10B and the lower surface of projecting section 16B. Projecting sections 161B to 163B are horizontally on the same position. In addition, as illustrated in FIG. 16, projecting section 162B and projecting sections 163B are disposed to overlap each other in the insertion/removal direction of plug connector 1B. Specifically, recessed section 10B and projecting section 16B can prevent the lower surface of plug connector 1B from being stuck at the insertion opening of the receptacle connector, when plug connector 1B coupled to FPC 2B which is reinforced by reinforcement plate 4B is inserted or removed into or from the receptacle connector.

In addition, projecting sections 161B to 163B are formed to correspond to a planar pattern of coupling region 211B so that projecting section 162B is formed to correspond to slit 24B and slit 42B. Therefore, FPC 2B and reinforcement plate 4B are substantially fixed in a planar direction in the state of being fitted in recessed section 10B, thereby being easily positioned with respect to plug connector 1B.

Meanwhile, since coupling region 211B of FPC 2B is sandwiched between reinforcement plate 4B and plug connector 1B, sandwiching sections 44B and 1*a*B for sandwiching coupling region 211B of FPC 2B therebetween are formed respectively on reinforcement plate 4B and plug connector 1B. Specifically, in the present exemplary embodiment, plug housing 11B has recessed section 10B, and the shape of recessed section 10B corresponds to the shape of coupling region 211B. Coupling region 211B is sandwiched between reinforcement plate 4B and plug connector 1B in the state of being stored in recessed section 10B.

That is, reinforcement plate 4B and plug connector 1B are respectively provided with sandwiching sections 44B and 1*a*B for sandwiching coupling region 211B of FPC (cable) 2B therebetween.

In addition, the plurality of FPC terminals (cable terminals) 221B are arranged in the width direction of the cable. Sandwiching sections 44B of reinforcement plate 4B and sandwiching sections 1*a*B of plug connector 1B are formed on both sides of arranged FPC terminals (cable terminals) 221B in the width direction of the cable.

Specifically, both ends of FPC (cable) 2B in the width direction of the cable are sandwiched between sandwiching sections 44B of reinforcement plate 4B and sandwiching sections 1*a*B of plug connector 1B.

As illustrated in FIG. 16, ends 11*a*B of sandwiching sections 1*a*B, close to extension region 212B, of plug connector 1B are located closer to extension region 212B than ends 4*a*B of sandwiching sections 44B, close to extension region 212B, of reinforcement plate 4B.

In addition, throughout from one end to the other end in the width direction of the cable, ends 11*a*B of sandwiching sections 1*a*B, close to extension region 212B, of plug connector 1B are located closer to extension region 212B than ends 4*a*B of sandwiching sections 44B, close to extension region 212B, of reinforcement plate 4B.

According to the connector set in the third exemplary embodiment of the present disclosure, connection sections 121B of plug terminals 12B stored in plug housing 11B are disposed in a predetermined pattern such that connection sections 121B are exposed from plug housing 11B, whereby connection and coupling with FPC 2B are facilitated. Thus, complicated work in the connection process is removed, and production cost of a product using the connector set can be reduced.

In addition, according to plug connector 1B in the third exemplary embodiment of the present disclosure, when FPC (cable) 2B is flapped and moved in the direction away from reinforcement plate 4B, the side of FPC (cable) 2B closer to extension region 212B than reinforcement plate 4B is held by ends 11*a*B of sandwiching sections 1*a*B, close to extension region 212B, of plug connector 1B which is harder than FPC (cable) 2B. Therefore, before FPC (cable) 2B is peeled from reinforcement plate 4B, ends 11*a*B of sandwiching sections 1*a*B, close to extension region 212B, of plug connector 1B can prevent FPC (cable) 2B from being flapped. Thus, FPC (cable) 2B can be prevented from being peeled from reinforcement plate 4B.

In this case, if both ends of FPC (cable) 2B in the width direction of the cable are sandwiched between sandwiching sections 44B of reinforcement plate 4B and sandwiching sections 1*a*B of plug connector 1B, FPC (cable) 2B can more reliably be prevented from being peeled from reinforcement plate 4B.

Fourth Exemplary Embodiment

A plug connector in a connector set can be configured as plug connector 1C illustrated in FIGS. 17 to 20.

Plug connector 1C according to the fourth exemplary embodiment of the present disclosure is connected to flexible printed circuit 2C (hereinafter referred to as FPC 2C) which extends in the direction along an insertion/removal direction of plug connector 1C and mounting substrate which is not illustrated, as in plug connector 1 described in the first exemplary embodiment. In addition, plug connector 1C is fitted in a receptacle connector, which is not illustrated, to constitute a portion of connector set 5. Note that the receptacle connector in which plug connector 1C according to the fourth exemplary embodiment of the present disclosure is fitted can be configured to have a shape almost similar to the shape of receptacle connector 3 in the first exemplary embodiment.

Plug connector 1C has plug housing 11C having substantially a rectangular solid shape, and a plurality of plug terminals 12C stored in plug housing 11C. Plug terminals 12C are arrayed in line in the lateral direction (horizontal direction) in plug housing 11C.

Plug housing 11C is injection molded from a resin material, for example, and is harder than FPC (cable) 2C. Plug housing 11C has, on the top surface thereof, hook 14C that locks plug connector 1C in the state of being fitted in the receptacle connector, release button 15C that releases the lock by hook 14C, and a plurality of guide grooves 19C. Release button 15C is connected to hook 14C, and when being pressed, it displaces in conjunction with hook 14C. Guide grooves 19C are formed along the insertion/removal direction of plug connector 1C into/from the receptacle connector.

FPC 2C is a sheet-shaped cable having support body 21C and conductor layer 22C supported by support body 21C. Support body 21C is formed of a plurality of insulator films, and covers conductor layer 22C. Conductor layer 22C is a conductive film printed on the insulator films, and forms a plurality of wiring patterns each corresponding to each of plug terminals 12C.

Figure 17:
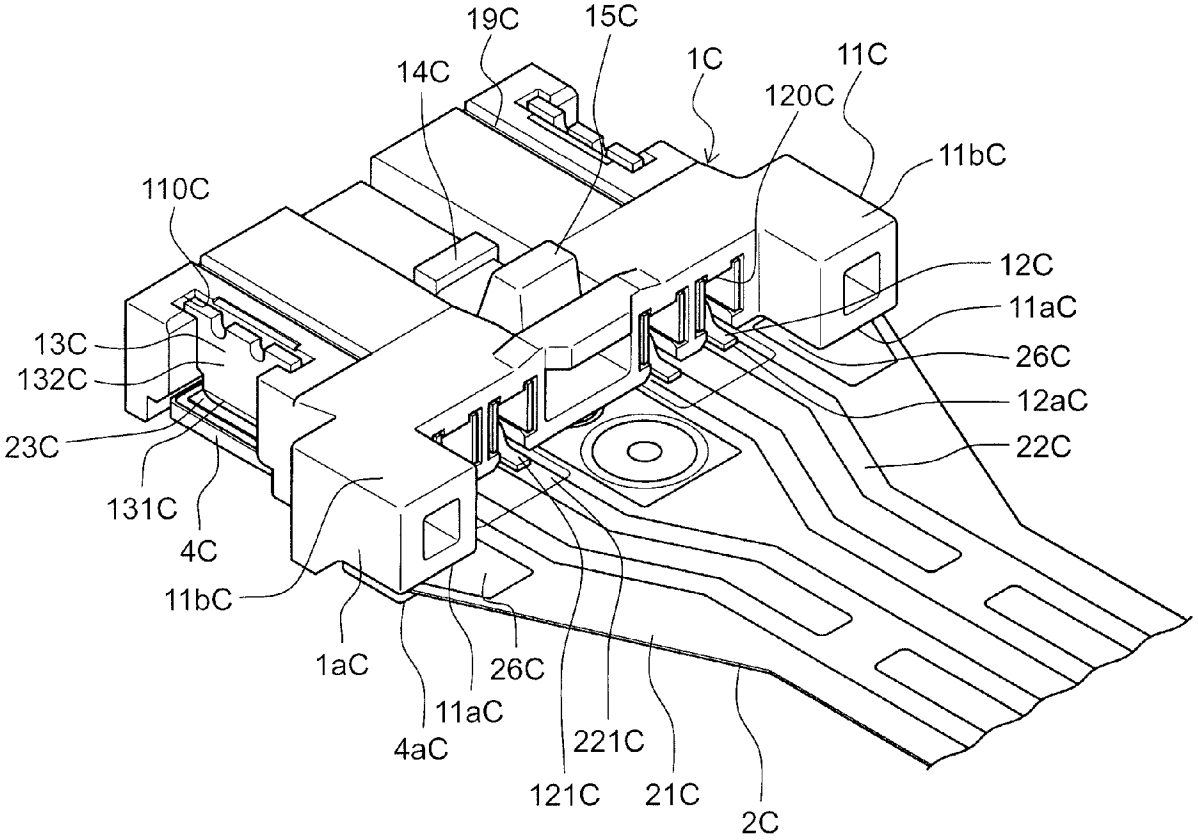
FIG. 17 is a perspective view for describing a plug connector in a connector set according to a fourth exemplary embodiment of the present disclosure.

As illustrated in FIG. 17, plug housing 11C has a plurality of storing sections 120C extending from one end face to the other end face in the insertion/removal direction of plug connector 1C into/from the receptacle connector. Plug terminals 12C are inserted into plug housing 11C from openings of storing sections 120C on the side opposite to the receptacle connector, and stored in plug housing 11C. The openings of storing sections 120C on the receptacle connector side are formed to be narrower than the openings on the opposite side so as to prevent plug terminals 12C from falling out. Although not illustrated, the openings of storing sections 120C on the receptacle connector side serve as an inlet opening into which receptacle terminals enter, and the peripheral edge of the inlet opening is formed into a tapered shape so as to facilitate the entry of the receptacle terminals.

Plug terminals 12C can be configured to have shapes almost similar to the shapes of plug terminals 12 in the first exemplary embodiment. For example, each of plug terminals 12C is formed such that a metal plate is stamped into a predetermined shape, and then, the resultant is bent. Specifically, each of plug terminals 12C has connection section 121C connected to FPC 2C and a contact section (not illustrated in FIG. 17) which is in contact with the receptacle terminal (not illustrated in FIG. 17) in the state in which plug connector 1C is fitted in the receptacle connector. Connection sections 121C are disposed such that connection sections 121C are exposed from plug housing 11C so that connection sections 121C are connectable to a plurality of FPC terminals (cable terminals) 221C of single FPC 2C. That is, connection sections 121C are located on the same plane formed by FPC 2C. Each of the contact sections is partially bent so as to hold or press the receptacle terminal in the state in which plug connector 1C is fitted in the receptacle connector.

Plug housing 11C has holders 110C for holding fixing members 13C that fix plug housing 11C and FPC 2C to each other when plug housing 11C is connected to FPC 2C. Each of holders 110C is formed to correspond to the shape of fixing member 13C on each of both side surfaces of plug connector 1C in the arraying direction of plug terminals 12C. Each of fixing members 13C is substantially a flat plate extending in the vertical direction, and formed of a metal material. Each of fixing members 13C has connection section 131C formed by bending fixing member 13C on the bottom part thereof, and fixing section 132C which is the remainder except for connection section 131C, fixing section 132C having a horizontal width larger than that of connection section 131C. Fixing members 13C are inserted into holders 110C from the top surface of plug housing 11C, and holders 110C hold fixing members 13C in a state in which connection sections 131C are exposed from the lower surface of plug housing 11C.

Figure 19:
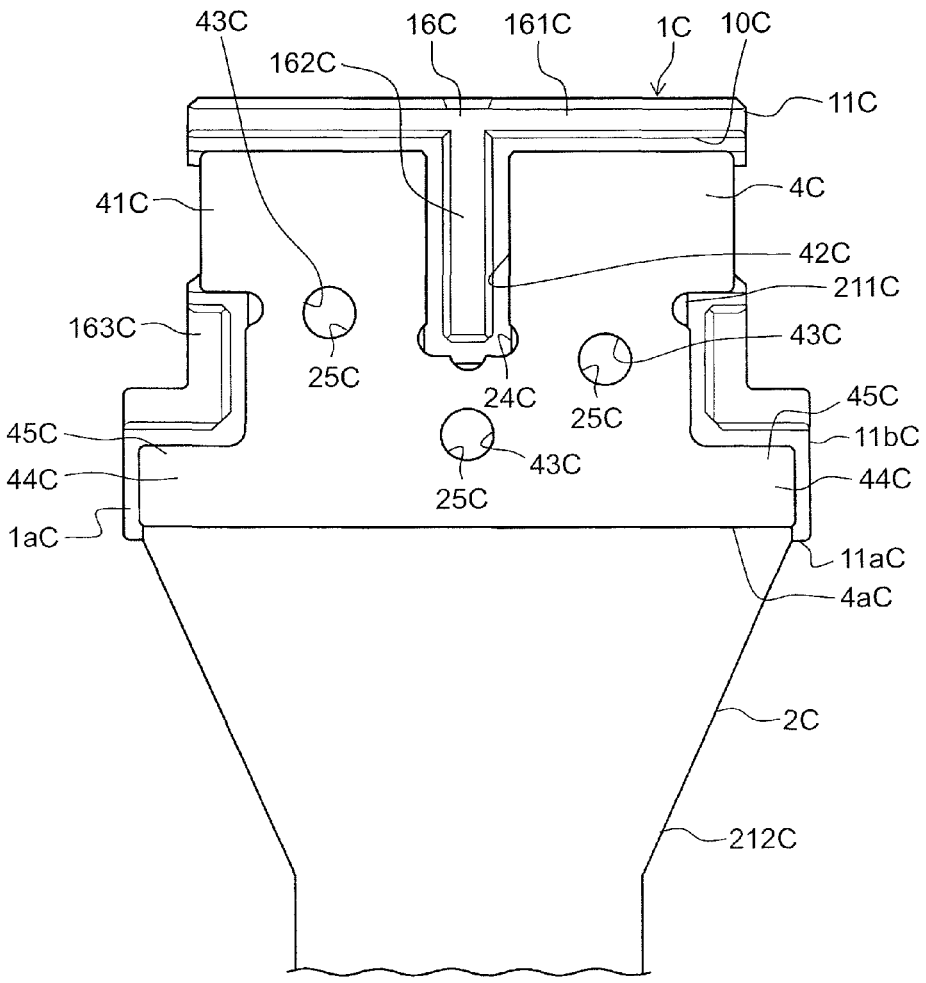
FIG. 19 is a back view for describing the plug connector in the connector set according to the fourth exemplary embodiment of the present disclosure.

As illustrated in FIG. 19, plug housing 11C has, on the lower surface thereof, recessed section 10C which is formed to be recessed corresponding to the shape of FPC 2C, and projecting section 16C which is the remainder except for recessed section 10C. Recessed section 10C is formed into a horizontal plane with a size, smaller than that of projecting section 16B, in the vertical direction of plug housing 11C. Recessed section 10C is formed such that the positions of the lower ends of connection sections 121C of plug terminals 12C and the positions of the lower ends of connection sections 131C of fixing members 13C are vertically the same.

Projecting section 16C on the lower surface of plug housing 11C has: projecting section 161C which is formed to serve as one side on the receptacle connector side; projecting section 162C extending from the center of projecting section 161C in the direction orthogonal to projecting section 161C; and projecting sections 163C separated from projecting sections 161C and 162C. Projecting section 162C extends to the center of recessed section 10C from projecting section 161C. Projecting sections 163C are formed on both sides of plug housing 11C in the extending direction of projecting section 161C. Projecting sections 163C are formed such that the ends thereof close to extension region 212C are bent outwardly in the extension direction of projecting section 161C. Connection section 131C of fixing member 13C is located between one end of projecting section 161C and projecting section 163C, and connection section 131C of another fixing member 13C is located between the other end of projecting section 161C and projecting section 163C (see FIG. 17).

As illustrated in FIG. 19, FPC 2C has: coupling region 211C used for the coupling with plug connector 1C; and extension region 212C on which conductor layer 22C for wiring with other circuit extends. Coupling region 211C is located on one end of extension region 212C. Extension region 212C is located on the side opposite to the receptacle connector, in a state in which coupling region 211C is coupled to plug connector 1C.

FPC 2C has, on the upper surface thereof in coupling region 211C, a plurality of FPC terminals 221C which is conductor layer 22C exposed from support body 21C, and connection terminals 23C connected to fixing members 13C. Coupling region 211C is formed to correspond to the shape of recessed section 10C of plug housing 11C. Alternatively, recessed section 10C is formed to correspond to the shape of coupling region 211C of FPC 2C on which FPC terminals 221C are formed. Connection terminals 23C are formed in the same manner as conductor layer 22C in the printing process of conductor layer 22C, for example.

As illustrated in FIG. 17, connection terminals 23C are formed on positions corresponding to the positions of fixing members 13C, and formed to project in the direction orthogonal to the insertion/removal direction of plug connector 1C on both ends of coupling region 211C. Besides, FPC 2C has, on coupling region 211C, slit 24C formed to correspond to projecting section 162C and through-holes 25C formed to be located on recessed section 10C.

Plug connector 1C is coupled to FPC 2C by connecting plug terminals 12C and FPC terminals 221C to each other by soldering in a state in which coupling region 211C of FPC 2C is stored in recessed section 10C. Plug connector 1C is strongly fixed to FPC 2C by connecting connection sections 131C of fixing members 13C held by holders 110C to connection terminals 23C by soldering.

As illustrated in FIGS. 17 and 19, plug connector 1C may further have reinforcement plate 4C for reinforcing FPC 2C that has been coupled. Reinforcement plate 4C is formed of glass epoxy resin, stainless steel, or the like, for example, and is harder than FPC (cable) 2C. In addition, reinforcement plate 4C is formed to correspond to the shape of coupling region 211C of FPC 2C. Reinforcement plate 4C has almost the same shape as coupling region 211C in a plan view. Specifically, reinforcement plate 4C has protruding sections 41C corresponding to the positions of connection terminals 23C, slit 42C corresponding to slit 24C, and through-holes 43C corresponding to through-holes 25C. Reinforcement plate 4C holds coupling region 211C of FPC 2C with plug connector 1C in the state in which coupling region 211C is stored in recessed section 10C, thereby reinforcing coupling region 211C of FPC 2C. Reinforcement plate 4C is positioned with respect to coupling region 211C, and attached on the back surface of FPC 2C by means of an adhesive.

Specifically, in the present exemplary embodiment, coupling region 211C of the cable (FPC 2C) on which a plurality of cable terminals (FPC terminals 221C) is formed is held between reinforcement plate 4C and plug connector 1C.

The total thickness of FPC 2C and reinforcement plate 4C which are attached to each other is equal to or less than the difference between the lower surface of recessed section 10C and the lower surface of projecting section 16C. Projecting sections 161C to 163C are horizontally on the same position. In addition, as illustrated in FIG. 19, projecting section 162C and projecting sections 163C are disposed to overlap each other in the insertion/removal direction of plug connector 1C. Specifically, recessed section 10C and projecting section 16C can prevent the lower surface of plug connector 1C from being stuck at an insertion opening of the receptacle connector, when plug connector 1C coupled to FPC 2C which is reinforced by reinforcement plate 4C is inserted or removed into or from the receptacle connector.

In addition, projecting sections 161C to 163C are formed to correspond to a planar pattern of coupling region 211C so that projecting section 162C is formed to correspond to slit 24C and slit 42C. Therefore, FPC 2C and reinforcement plate 4C are substantially fixed in a planar direction in the state of being fitted in recessed section 10C, thereby being easily positioned with respect to plug connector 1C.

Meanwhile, since coupling region 211C of FPC 2C is sandwiched between reinforcement plate 4C and plug connector 1C, sandwiching sections 44C and 1*a*C for sandwiching coupling region 211C of FPC 2C therebetween are formed respectively on reinforcement plate 4C and plug connector 1C.

That is, reinforcement plate 4C and plug connector 1C are respectively provided with sandwiching sections 44C and 1*a*C for sandwiching coupling region 211C of FPC (cable) 2C therebetween.

In addition, the plurality of FPC terminals (cable terminals) 221C are arranged in the width direction of the cable. Sandwiching sections 44C of reinforcement plate 4C and sandwiching sections 1*a*C of plug connector 1C are formed on both sides of arranged FPC terminals (cable terminals) 221C in the width direction of the cable.

Specifically, both ends of FPC (cable) 2C in the width direction of the cable are sandwiched between sandwiching sections 44C of reinforcement plate 4C and sandwiching sections 1*a*C of plug connector 1C.

In the fourth exemplary embodiment of the present disclosure, widened sections 26C are formed outwardly of FPC terminals (cable terminals) 221C arranged on FPC (cable) 2C on both sides of FPC (cable) 2C in the width direction of the cable.

Each of widened sections 26C is sandwiched between sandwiching section 1*a*C of plug connector 1C and sandwiching section 44C of reinforcement plate 44C. Specifically, both sides of plug housing 11C in the width direction of the cable protrude toward extension region 212C to form protruding sections 11*b*C, and protruding sections 11*b*C serve as sandwiching sections 1*a*C. On the other hand, protruding sections 45C protruding toward both sides in the width direction of the cable are formed on reinforcement plate 4C on the side close to extension region 212C. Protruding sections 45C serve as sandwiching sections 44C.

In this case, on both ends in the width direction of the cable, ends 11*a*C of sandwiching sections 1*a*C, close to extension region 212C, of plug connector 1C are located closer to extension region 212C than ends 4*a*C of sandwiching sections 44C, close to extension region 212C, of reinforcement plate 4C, as illustrated in FIG. 19.

Figure 18:
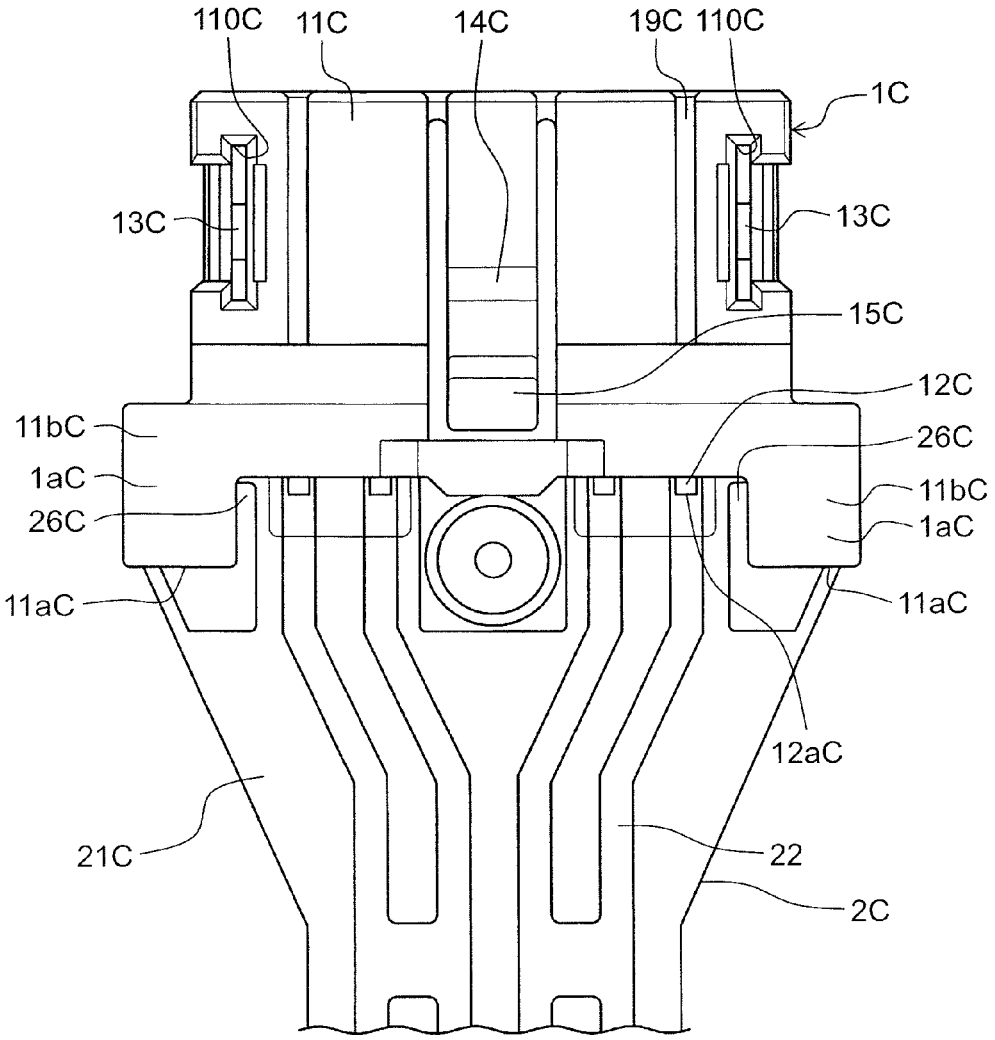
FIG. 18 is a plan view for describing the plug connector in the connector set according to the fourth exemplary embodiment of the present disclosure.

In addition, on both ends in the width direction of the cable, ends 4*a*C of sandwiching sections 44C, close to extension region 212C, of reinforcement plate 4C are located closer to extension region 212C than ends 12*a*C of connection sections 121C close to extension region 212C, as illustrated in FIGS. 18 and 19.

Figure 20:
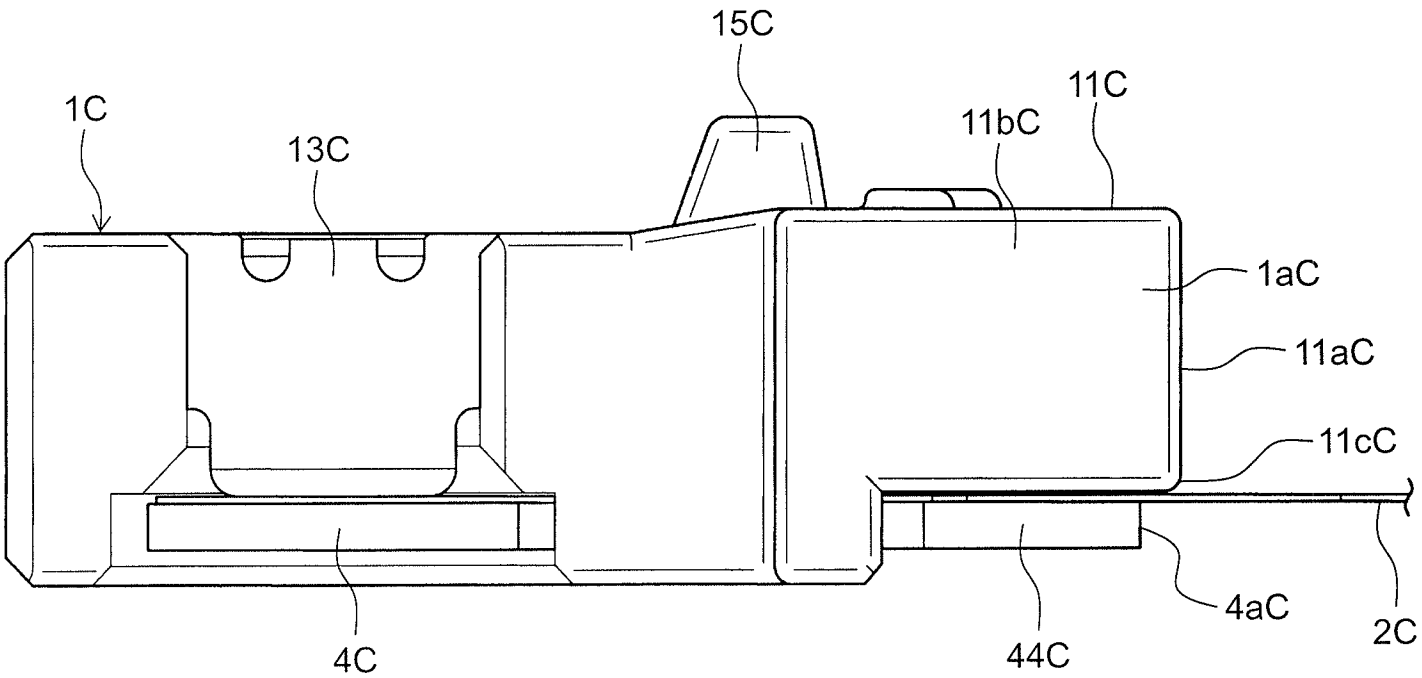
FIG. 20 is a front view for describing the plug connector in the connector set according to the fourth exemplary embodiment of the present disclosure.

In addition, as illustrated in FIG. 20, rounded sections 11*c*C (hereinafter referred to as R sections 11*c*C) are formed on ends 11*a*C, close to extension region 212C, of sandwiching sections 1*a*C of plug connector 1C on the cable side.

According to the connector set in the fourth exemplary embodiment of the present disclosure, connection sections 121C of plug terminals 12C stored in plug housing 11C are disposed in a predetermined pattern such that connection sections 121C are exposed from plug housing 11C, whereby connection and coupling with FPC 2C are facilitated. Thus, complicated work in the connection process is removed, and production cost of a product using the connector set can be reduced.

In addition, according to plug connector 1C in the fourth exemplary embodiment of the present disclosure, when FPC (cable) 2C is flapped and moved in the direction away from reinforcement plate 4C, the side of FPC (cable) 2C closer to extension region 212C than reinforcement plate 4C is held by ends 11*a*C of sandwiching sections 1*a*C, close to extension region 212C, of plug connector 1C which is harder than FPC (cable) 2C. Therefore, before FPC (cable) 2C is peeled from reinforcement plate 4C, ends 11*a*C of sandwiching sections 1*a*C, close to extension region 212C, of plug connector 1C can prevent FPC (cable) 2C from being flapped. Thus, FPC (cable) 2C can be prevented from being peeled from reinforcement plate 4C.

In this case, if both ends (widened sections 26C) of FPC (cable) 2C in the width direction of the cable are sandwiched between sandwiching sections 44C of reinforcement plate 4C and sandwiching sections 1*a*C of plug connector 1C, FPC (cable) 2C can more reliably be prevented from being peeled from reinforcement plate 4C.

In addition, if ends 4*a*C, close to extension region 212C, of sandwiching sections 44C of reinforcement plate 4C are located closer to extension region 212C than ends 12*a*C of connection sections 121C close to extension region 212C, deformation of connection sections 121C because of FPC (cable) 2C being flapped can be suppressed. Specifically, connection sections 121C can be protected from flapped FPC (cable) 2C.

In addition, if R sections 11*c*C are formed on ends 11*a*C, close to extension region 212C, of sandwiching sections 1*a*C of plug connector 1C on the cable side, flapped FPC (cable) 2C can be prevented from being broken by sandwiching sections 1*a*C of plug connector 1C.

Other Exemplary Embodiments

While the present disclosure has been described by way of the exemplary embodiments, it should not be understood that statements and drawings, that form a part of the disclosure, limit the present disclosure. Various alternate exemplary embodiments, examples and operation technologies will become apparent to those skilled in the art from this disclosure.

In addition, while a flexible printed circuit (FPC) is used as a sheet-shaped cable in the first to fourth exemplary embodiments described previously, a sheet-shaped wiring cable such as a flexible flat cable (FFC) or the like may be used.

Further, in the first exemplary embodiment described above, plug connector 1 has been described in which recessed section 10 is formed on the surface facing mounting substrate 39 out of outer surfaces of plug housing 11. However, recessed section 10 may be formed on the surface opposite to mounting substrate 39 out of the outer surfaces of plug housing 11. In this case, receptacle connector 3 may be vertically inverted so that plug connector 1 having recessed section 10 on the top surface thereof can be fitted therein. In addition, the positional relation and mounting manner between receptacle connector 3 and mounting substrate 39 may be changed as appropriate. Note that the same is applied to the third and fourth exemplary embodiments described above.

Besides, it is a matter of course that the present disclosure incorporates a variety of exemplary embodiments and the like, which are not described herein, such as a configuration made by applying a portion of the configurations described in the first to fourth exemplary embodiments to one another. Hence, the technical scope of the present disclosure should be determined only by the invention specifying matters according to the scope of claims appropriate from the above description.

REFERENCE MARKS IN THE DRAWINGS

1, 1A, 1B, 1C plug connector
1*a*B, 1*a*C sandwiching section
2, 2A, 2B, 2C flexible printed circuit (FPC)
3, 3A receptacle connector
4, 4A, 4B, 4C reinforcement plate
4*a*B, 4*a*C end
5, 5A connector set
10, 10B, 10C recessed section
11, 11A, 11B, 11C plug housing
11*a*B, 11*a*C end
11*b*C protruding section
11*c*C rounded section
12, 12A, 12B, 12C plug terminal
12*a*C end
13, 13A, 13B, 13C fixing member
14, 14B, 14C hook
15, 15B, 15C release button
16, 16B, 16C projecting section
19, 19B, 19C guide groove
21, 21B, 21C support body
22, 22B, 22C conductor layer
23, 23A, 23B, 23C connection terminal
24, 24B, 24C slit
25, 25B, 25C through-hole
26C widened section
30, 30A insertion opening
31, 31A receptacle housing
32, 32A fixing member
33, 33A receptacle terminal
34, 34A guide rib
35 hook receiving section
39, 39A mounting substrate
41, 41B, 41C protruding section
42, 42B, 42C slit
43, 43B, 43C through-hole
44B, 44C sandwiching section
45C protruding section
100, 100A inlet opening
101 molding failure
110 holder
110A, 110B, 110C holder
111A hook receiving section
120, 120B, 120C storing section
121, 121A, 121B, 121C connection section
122, 122A contact section
131, 131A, 131B, 131C connection section
132, 132A, 132B, 132C fixing section
133A hook
161, 161B, 161C, 162, 162B, 162C, 163, 163B, 163C projecting section
211, 211B, 211C coupling region
212, 212B, 212C extension region

221, 221A, 221B, 221C FPC terminal (cable terminal)
310A holder
311A hook receiving section
321, 321A connection section
322, 322A fixing section
323A hook
331, 331A connection section
332, 332A contact section

What is claimed is:

1. A plug connector to be fitted in an opening of a receptacle connector,
the plug connector comprising:
a plug housing having a lower exterior surface; and
a plurality of plug terminals stored in the plug housing,
the receptacle connector having a receptacle terminal,
the plug connector being connected to a cable having a sheet shape and including a cable terminal, so that electrical connection is established between the receptacle terminal and the cable terminal, wherein
each of the plug terminals has a contact section and a connection section, the connection section extending toward the lower exterior surface of the plug housing,
the contact section is contactable with the receptacle terminal,
the connection section is connectable to the cable terminal,
the connection section is disposed such that the connection section is exposed from the plug housing in a state in which the plug connector is fitted in the receptacle connector,
the plug housing has a recessed section provided on the lower exterior surface of the plug housing,
the recessed section is configured to store a coupling region of the cable on which the cable terminal is formed, and
when the plug connector is inserted into the opening of the receptacle connector, the coupling region of the cable is sandwiched between the recessed section of the plug connector and an inner surface of the receptacle connector defining the opening.

2. The plug connector according to claim 1, wherein
a shape of the recessed section corresponds to a shape of the coupling region of the cable on which the cable terminal is formed.

3. The plug connector according to claim 1, wherein
when the receptacle connector is mounted on a mounting substrate, the recessed section is located on a surface facing the mounting substrate out of outer surfaces of the plug housing.

4. The plug connector according to claim 1, wherein
the cable terminal and the connection section are connected to the cable by being connected to each other by soldering.

5. The plug connector according to claim 1, further comprising
a reinforcement plate,
wherein
the coupling region of the cable on which a plurality of the cable terminals is formed is sandwiched between the reinforcement plate and the plug connector.

6. The plug connector according to claim 5, wherein
the reinforcement plate is formed to correspond to a shape of the coupling region.

7. The plug connector according to claim 6, wherein
a shape of the recessed section corresponds to a shape of the coupling region, and
the coupling region is sandwiched between the reinforcement plate and the plug connector in a state in which the coupling region is stored in the recessed section.

8. The plug connector according to claim 5, wherein
the cable has the coupling region and an extension region extending from the coupling region,
the reinforcement plate has a sandwiching section for sandwiching the coupling region of the cable,
the plug connector has a sandwiching section for sandwiching the coupling region of the cable, and
an end of the sandwiching section, closer to the extension region, of the plug connector is located closer to the extension region with respect to an end of the sandwiching section, closer to the extension region, of the reinforcement plate.

9. The plug connector according to claim 8, wherein
the end of the sandwiching section, closer to the extension region, of the reinforcement plate is located closer to the extension region with respect to the end of the connection section closer to the extension region.

10. The plug connector according to claim 8, wherein
the cable terminals are arranged in a width direction of the cable, and
the sandwiching section of the reinforcement plate and the sandwiching section of the plug connector are formed on both sides of the arranged cable terminals in the width direction of the cable.

11. The plug connector according to claim 10, wherein
the cable has widened sections formed on both sides of the arranged cable terminals in the width direction of the cable, and
each of the widened sections is sandwiched between the sandwiching section of the plug connector and the sandwiching section of the reinforcement plate.

12. The plug connector according to claim 8, wherein
a rounded section is formed on the end of the sandwiching section, closer to the extension region, of the plug connector.

13. The plug connector according to claim 8, wherein
the plug housing and the reinforcement plate are harder than the cable.

14. A connector set comprising:
the plug connector according to claim 1; and
the receptacle connector.

15. A plug connector to be fitted in a receptacle connector, the plug connector comprising:
a plug housing; and
a plurality of plug terminals stored in the plug housing,
the plug connector being fitted in the receptacle connector having a receptacle terminal,
the plug connector being connected to a cable having a sheet shape and including a cable terminal, so that electrical connection is established between the receptacle terminal and the cable terminal, wherein
each of the plug terminals has a contact section and a connection section,
the contact section is contactable with the receptacle terminal,
the connection section is connectable to the cable terminal, and
the connection section is disposed such that the connection section is exposed from the plug housing in a state in which the plug connector is fitted in the receptacle connector,
the plug connector further comprising:
a reinforcement plate, wherein a coupling region of the cable on which a plurality of the cable terminals is formed is sandwiched between the reinforcement plate and the plug connector, the cable has the coupling region and an extension region extending from the coupling region, the reinforcement plate has a sandwiching section for sandwiching the coupling region of the cable, the plug connector has a sandwiching section for sandwiching the coupling region of the cable, and an end of the sandwiching section, closer to the extension region, of the plug connector is located closer to the extension region with respect to an end of the sandwiching section, closer to the extension region, of the reinforcement plate.

* * * * *